US007652548B2

(12) United States Patent
Yoshikawa et al.

(10) Patent No.: US 7,652,548 B2
(45) Date of Patent: Jan. 26, 2010

(54) BANDPASS FILTER, HIGH-FREQUENCY MODULE, AND WIRELESS COMMUNICATIONS EQUIPMENT

(75) Inventors: Hiromichi Yoshikawa, Kirishima (JP); Katsurou Nakamata, Kirishima (JP)

(73) Assignee: Kyocera Corporation, Kyoto (JP)

( * ) Notice: Subject to any disclaimer, the term of this patent is extended or adjusted under 35 U.S.C. 154(b) by 270 days.

(21) Appl. No.: 11/410,321

(22) Filed: Apr. 24, 2006

(65) Prior Publication Data

US 2006/0255885 A1 Nov. 16, 2006

(30) Foreign Application Priority Data

Apr. 25, 2005 (JP) ..... 2005-126823
Sep. 5, 2005 (JP) ..... 2005-256301

(51) Int. Cl.
*H01P 3/08* (2006.01)
*H01P 1/20* (2006.01)
*H01P 7/00* (2006.01)

(52) U.S. Cl. ..... 333/204; 333/202; 333/219

(58) Field of Classification Search ..... 333/202, 333/204, 205, 219
See application file for complete search history.

(56) References Cited

U.S. PATENT DOCUMENTS 5,719,539 A * 2/1998 Ishizaki et al. ..... 333/204
5,892,415 A 4/1999 Okamura
6,020,799 A * 2/2000 Ishizaki et al. ..... 333/204
6,147,571 A * 11/2000 Kitazawa et al. ..... 333/126
7,126,444 B2 10/2006 Fukunaga et al.
2005/0052262 A1 3/2005 Fukunaga et al.
2007/0171005 A1* 7/2007 Fukunaga ..... 333/219
2007/0205851 A1* 9/2007 Fukunaga ..... 333/204

FOREIGN PATENT DOCUMENTS

CN 1153426 A 7/1997
CN 1591965 A 3/2005

OTHER PUBLICATIONS

Karen Li et al., "An Ultra-Wideband Bandpass Filter Using Broadside-Coupled Microstrip-Coplanar Waveguide Structure", IEEE MTT-S-Sym., WE2F, Jun. 2005.
English translation of Chinese office action for corresponding Chinese application 200610077766.5 lists the references above.

* cited by examiner

*Primary Examiner*—Robert Pascal
*Assistant Examiner*—Kimberly E Glenn
(74) *Attorney, Agent, or Firm*—Hogan & Hartson LLP

(57) ABSTRACT

There is included: N (N≧2) resonators formed by laminating a plurality of conductor patterns and dielectric layers alternately and arranged in an at least partially overlapped manner when viewed in the laminating direction to be coupled electromagnetically to each other; and input and output lines 3 and 4 coupled, respectively, to two resonators 1 and 2 selected among the N resonators, in which one end of each of the N resonators is grounded, and the length of each of the N resonators in the signal propagation direction is basically λ/4, where λ represents a propagation wavelength inside the dielectric layers at approximately the center frequency of the pass band. A wider pass bandwidth, size and loss reduction, and a large amount of attenuation within a narrow band can be achieved.

25 Claims, 30 Drawing Sheets

BANDPASS FILTER, HIGH-FREQUENCY MODULE, AND WIRELESS COMMUNICATIONS EQUIPMENT

BACKGROUND OF THE INVENTION

1. Field of the Invention

The present invention relates to a bandpass filter high-frequency module with wideband and steep attenuation characteristics to be used preferably in UWB (Ultra Wide Band) wireless communications fields, and to wireless communications equipment using the same. UWB is expected to be used as data transmission medium for PC peripherals such as PC adaptors, external storage devices, printers, scanners, and hubs or for digital consumer electronics such as digital TVs, projectors, 5.1 ch speaker systems, and video cameras.

2. Description of the Related Art

UWB (Ultra Wide Band) has drawn attention recently as a new communications system.

UWB is a communications system for achieving large-volume data transmission with a pass band of 3.1 to 10.6 GHz.

Comparing UWB with wireless local area networks (hereinafter referred to as W-LAN) for use as one of data communications means, there are differences in communications distance and data transmission rate. W-LANs have a communications distance of 30 to 100 m, transmission power of 500 mW, and communications speed of approximately 11 Mbps, while UWB applications, though having a shorter communications distance of 10 m, allow for lower power consumption with a transmission power of 100 mW and for higher-speed data transmission with a communications speed of 100 Mbps at a communications distance of around 10 m and 480 Mbps at a communications distance of 2 m or less.

The U.S. FCC regulations make some arrangements for the frequency band to be used in UWB applications, and a wide band of 3.1 to 10.6 GHz will be used therein.

As mentioned above, one characteristic of UWB applications is to use a wide band. The relative band (bandwidth/center frequency) thereof is required to be 40% or more, and further 108% in some cases.

Also, the average transmission power density of UWB applications is defined to be a low value of less than −41.3 dBm/MHz. Here, −41.3 dBm/MHz is equivalent to radiation power generating an electric field intensity 54 dBμV=500 μV/m at a distance of 3 m from the wave source.

As mentioned above, another characteristic of UWB applications is to require a lower transmission power.

Meanwhile, the FCC defines the spectrum mask under an outdoor environment to be, for example, −20 dB at 3.1 GHz and −30 dB at 1.61 GHz using the transmission power within a pass band of 3.16 to 4.75 GHz as a reference (0 dB). It is also necessary to take account of the impact with W-LANs (802.11.a) under practical service conditions, requiring attenuation at 5.15 GHz.

Therefore, still another characteristic of UWB applications is to require the transmission power spectrum to be attenuated steeply within narrow bands adjacent to the pass band.

[Related Art Document 1] K. Li, K. Kurita, and T. Matsui, "An ultra-wideband bandpass filter using broadside coupled microstrip-coplanar waveguide structure," IEEEMTT-S Sym., WE2F, June 2005.

For the foregoing reasons, filters inserted in the pathway of transmitting and received signals in UWB wireless communications equipment are required to have wideband, low-loss, and highly attenuating characteristics near the pass band.

Meanwhile, planar circuit filters have been employed using a dielectric substrate as well-used filters.

FIG. 45 is a perspective view showing a planar circuit filter in which two microstrip lines 31 and 32 are arranged side by side on a dielectric substrate 33.

The two microstrip lines 31 and 32 are arranged side by side on the same wiring layer with one for input and the other for output, and the long sides of the lines are brought close to each other to be coupled. Such a coupling by arranging two resonators side by side on the same plane is a so-called "edge coupling." This coupling causes a resonance to achieve a narrowband filter.

However, since the two microstrip lines 31 and 32 are arranged side by side on the dielectric substrate in the planar circuit filter, there can be no strong coupling, resulting in difficulty in achieving a wideband filter having a relative bandwidth of 110%. It is also difficult to achieve steep attenuation characteristics. Forming an attenuation pole to improve the attenuation characteristics causes the circuit configuration to be complicated, also resulting in an increase in size. Therefore, the foregoing structure can be said to be not so suitable for a small-sized bandpass filter for UWB applications.

SUMMARY OF THE INVENTION

It is an object of the present invention to provide a small-sized and low-loss wideband bandpass filter high-frequency module having a wide pass bandwidth and capable of achieving high attenuation within a narrow band in UWB applications and wireless communications equipment using the same.

A bandpass filter according to the present invention comprises: N ($N \geqq 2$) resonators arranged in an at least partially overlapped manner when viewed in the laminating direction to be coupled electromagnetically to each other; and input and output parts coupled, respectively, to two resonators selected among the N resonators, wherein one end (grounded end) of each of the N resonators is grounded, and the length of each of the N resonators in the signal propagation direction is basically $\lambda/4$, where $\lambda$ represents a propagation wavelength at approximately the center frequency of the pass band.

The bandpass filter with the arrangement above can achieve a planar coupling (broadside coupling) within the portion where the N resonators are arranged in an overlapped manner. This increases the amount of coupling to allow for wideband low-loss transmission characteristics and steep out-of-band attenuation characteristics.

The N resonators each may employ a structure of including, for example, a strip line, a microstrip line, or a coplanar line. Shunting one end of the resonators having a structure of including such a line can obtain a length equivalent to $\lambda/4$.

The grounded one end of each of the resonators may exist at the same end of the resonators or at the opposite end to that of the former resonator when viewed in the laminating direction. This will be determined appropriately depending on a pass band required. Particularly, in the case of existing at the opposite end, the resonators can be coupled more strongly to achieve a wider bandwidth.

The input and output parts may include a capacitor or inductor element coupled to the resonators. In this case, since setting the element constant to a predetermined value allows the amount of coupling to be increased when inputting and outputting signals at the input and output parts, it is possible to reduce the passing loss of the bandpass filter.

The input and output parts may include input and output lines coupled to the resonators. In this case, since the input and output lines can be arranged on the substrate so as to be connected to another circuit, the height of the bandpass filter can be reduced advantageously.

Here, the input direction to the input line may be different from or the same as the output direction from the output line. This will be determined appropriately depending on a pass band required. Particularly, in the case of the same direction, the resonators can be coupled more strongly to achieve a wider bandwidth.

Also, open ends of the resonators each may be grounded via a capacitor element formed at a lumped constant or pattern. In respect to such a structure, the N resonators are preferably formed in a rectangular shape when viewed in the laminating direction, and grounding conductors are preferably provided in the same plane as the respective resonators in such a manner as to surround the respective resonators so that the one ends (grounded ends) of the rectangular resonators are only grounded. In this structure, since there is no need to use a via at the grounding portion of the resonators, it is possible to reduce fluctuations in production.

Further, capacitance is preferably added between open ends at the opposite to the grounded ends and portions of the grounding conductors near the open ends. Specifically, it is preferable that first conductors be provided near the upper or lower side of open ends in the resonators, and via conductors for connecting the first conductors and the respective grounding conductors be provided, so that the capacitance is formed between the resonators and the first conductors. Since this can further reduce the length of the resonators in the signal propagation direction, it is possible to reduce the longitudinal size of the bandpass filter and thereby to implement the bandpass filter at a higher density. It is also possible to shift higher modes toward the higher-frequency side, resulting in an improvement in out-of-band characteristics.

In addition, the areas on the grounded ends of the resonators each may be an inductor element formed at a lumped constant or pattern. For example, the N resonators are preferably formed in a stepwise or continuously narrowing manner toward the grounded ends when viewed in the laminating direction. Since this also can further reduce the length of the resonators in the signal propagation direction, it is possible to reduce the longitudinal size of the bandpass filter and thereby to implement the bandpass filter at a higher density. It is also possible to shift higher modes toward the higher-frequency side, resulting in an improvement in out-of-band characteristics.

In the bandpass filter according to the present invention, at least one of capacitance or inductance is preferably added for electromagnetic coupling between the input and output lines.

Specifically, it is preferable that a second conductor be provided in the same plane as the input line and a third conductor be provided in the same plane as the output line, and that a via conductor for connecting the second and third conductors be provided, so that the capacitance or inductance is added between the input and output lines. It is also preferable that a second conductor be provided near the upper or lower side of the input line and a third conductor be provided near the upper or lower side of the output line, and that a via conductor for connecting the second and third conductors be provided, so that the capacitance or inductance is added between the input and output lines. This allows a new attenuation pole to be formed outside the pass band and near the boundary between the pass band and the out-of-band region, resulting in further steep skirt characteristics. It is noted that the second and third conductors are preferably formed in a stepwise or continuously narrowing manner toward the portions connected to the via conductor when viewed in the laminating direction, in terms of providing inductance to shift the attenuation pole toward the lower-frequency side.

Also, in the bandpass filter according to the present invention, at least one of capacitance or inductance is preferably added for electromagnetic coupling between any two resonators selected among the N resonators.

Specifically, it is preferable that a fourth conductor be provided in the same plane as any one resonator among the N resonators and a fifth conductor be provided in the same plane as a resonator other than the one resonator, and that a via conductor for connecting the fourth and fifth conductors be provided, so that the capacitance or inductance is added between any two resonators. It is also preferable that a fourth conductor be provided near the upper or lower side of any one resonator among the N resonators and a fifth conductor be provided near the upper or lower side of a resonator other than the one resonator, and that a via conductor for connecting the fourth and fifth conductors be provided, so that the capacitance or inductance is added between any two resonators. This allows a new attenuation pole to be formed between the input and output lines outside the pass band and near the boundary between the pass band and the out-of-band region, resulting in further steep skirt characteristics.

Further, at least one resonator is preferably provided between the fourth or fifth conductor and the input or output part, and the resonator preferably covers the fourth and fifth conductors when viewed from the input and output parts. This can prevent the fourth or fifth conductor from being coupled unnecessarily to the input or output part to result in a resonance, whereby it is possible to suppress an unnecessary out-of-band resonance peak.

It is noted that the fourth and fifth conductors are preferably formed in a stepwise or continuously narrowing manner toward the portions connected to the via conductor when viewed in the laminating direction, in terms of providing inductance to shift the attenuation pole toward the lower-frequency side.

In the bandpass filter according to the present invention, it is possible to form a plurality of attenuation poles at the same time as far as the foregoing structure concerning pole formation allows. It is also possible to form an attenuation pole within the pass band as appropriate.

It is further possible to arrange two structures of the thus laminated resonators side by side. In this case, it is possible to turn the direction of signals by arranging a coupling conductor for coupling the bottom resonators to each other across the two structures. The length of the coupling conductor in the signal propagation direction is basically half of the wavelength.

With the arrangement above, it is possible to achieve the same effect as the case where the number of stages N is doubled, resulting in a reduction in the height of the bandpass filter. It is noted that more than two structures can further increase the number of stages without changing the height of the resonators.

In the case of using the input and output lines, the width of the input or output line is preferably formed stepwise at the end of a portion overlapping the resonators when viewed in the laminating direction. This allows the attenuation pole to be controlled, resulting in steep out-of-band attenuation characteristics.

It is also possible to produce a high-frequency module using the bandpass filter according to the present invention.

It is further possible to produce small-sized wireless communications equipment carrying the bandpass filter or the high-frequency module. In accordance with such wireless communications equipment, it is possible to achieve an improvement in receiving sensitivity, wideband communications, lower power consumption, and prevention of mutual interferences with wireless LANs, etc.

The foregoing and other advantages, features, and effects of the present invention will become more apparent from the description of embodiments to be described hereinafter with reference to the accompanying drawings.

DETAILED DESCRIPTION OF PREFERRED EMBODIMENTS

Embodiments of the present invention will hereinafter be described based on the accompanying drawings.

Figure 1:
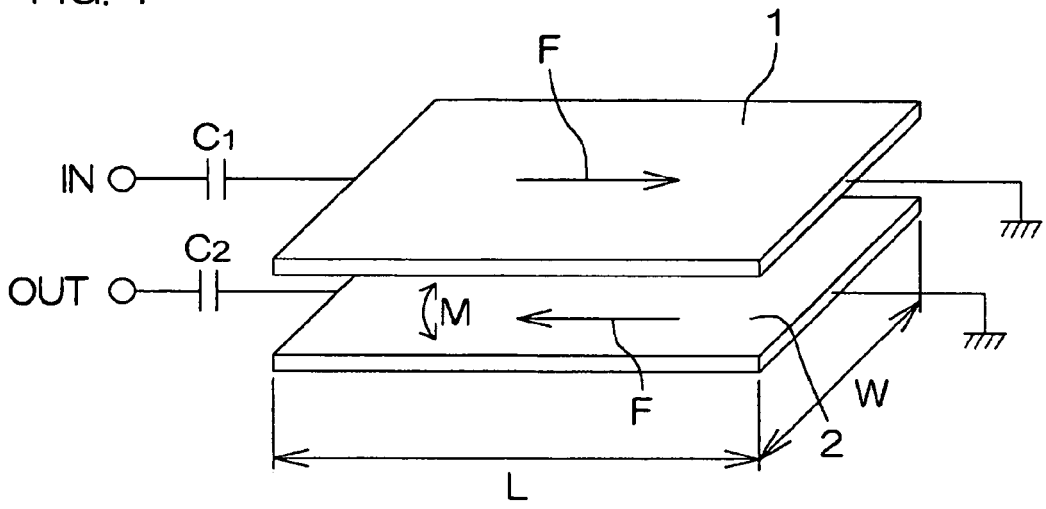
FIG. 1 is an illustrative view showing a circuit configuration example of a bandpass filter according to the present invention.

FIG. 1 is an illustrative view showing a circuit configuration example of a bandpass filter according to the present invention.

The bandpass filter comprises N (N≧2) resonators 1 and 2 laminated vertically at predetermined spacing (FIG. 1 shows two resonators).

Figure 9:
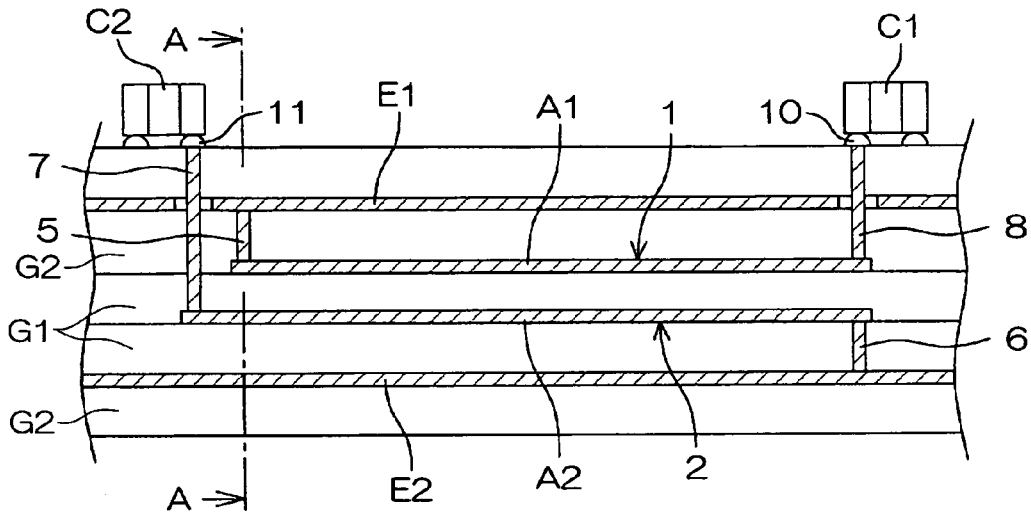
FIG. 9 is a cross-sectional view showing a structure where the bandpass filter shown in FIG. 2 is formed inside a dielectric multilayer substrate.

The resonators are formed by laminating a plurality of dielectric layers with, for example, conductor patterns formed on the respective upper surfaces thereof, the conductor patterns and the dielectric layers being laminated alternately. The dielectric layers are indicated by "G1" and "G2" as shown in FIG. 9 for example, though not shown in FIG. 1.

The conductor patterns each include a strip line, a microstrip line, or a coplanar line, etc.

Here, as an example where the resonators 1 and 2 each include a strip line or a microstrip line, there can be cited a structure where grounds constituting the lines (not shown in the figure) are arranged, for example, above the resonator 1 and/or below the resonator 2 shown in FIG. 1.

The two resonators 1 and 2 each include a conductor having the same size (the length in the signal propagation direction is basically λ/4, where λ represents a propagation wavelength inside the dielectric layers at approximately the center frequency of the pass band), and are arranged in an at least partially, and preferably in an almost entirely overlapped manner. Then, the two resonators 1 and 2 are coupled electromagnetically to each other through the overlapping arrangement (as indicated by M in FIG. 1). This coupling is a so-called "broadside coupling," a method for causing the principal surfaces of the vertical two resonators 1 and 2 to face each other for coupling.

It is noted here that when designing a narrowband filter, the center frequency and the resonant frequency are commonly made equal. However, when designing a wideband bandpass filter using a broadside coupling, the center frequency of the filter and the resonant frequency of the resonators cannot necessarily be made equal due to the strong coupling. It is therefore necessary to set the resonant frequency of the resonators to be a little higher than the center frequency of the filter, and the term "approximately" the center frequency here means including a frequency difference from the resonant frequency.

Also, input and output parts are coupled to one ends (end portions on the left in FIG. 1) of the two respective resonators 1 and 2, while the opposite ends (end portions on the right in FIG. 1) are both grounded (hereinafter referred to as grounded ends).

Further, the input direction to the input part and the output direction from the output part, that is, the signal propagation direction is indicated by "F" in FIG. 1. The length of the resonators along the signal propagation direction F (the longitudinal length of the resonators shown in FIG. 1) is basically λ/4, where λ represents a propagation wavelength inside the dielectric layers at approximately the center frequency of the pass band. The term "basically" is used here for the reason that it is necessary to change the length of the resonators slightly from λ/4 (fine-tune the length) to arrange the entire characteristics of the filter through, for example, coupling adjustment between the resonators, and that the length of the resonators can be reduced below λ/4 by utilizing a capacitor or inductor element as will be described hereinafter.

Then, the one ends of the resonators 1 and 2 shown in FIG. 1 are coupled electromagnetically to input and output electrodes IN and OUT, respectively, via capacitor elements C1 and C2. These electromagnetically coupled portions are referred to as the "input part" and "output part." That is, the capacitor elements C1 and C2 are included in and constitute the respective input and output parts. Here, inductor elements may be used, instead of the capacitor elements C1 and C2, as the coupling elements to be coupled to the resonators. In addition, it is not always necessary to use lumped constant elements, and distributed constant lines may be used to constitute the input and output parts. Further, input and output lines may be used to achieve a coupling across the entire plane (broadside coupling) as will be described hereinafter.

Such a structure as mentioned above allows the two resonators 1 and 2 to be coupled strongly to each other, which can widen the pass band. It is also possible to reduce the size of the bandpass filter.

Figure 2:
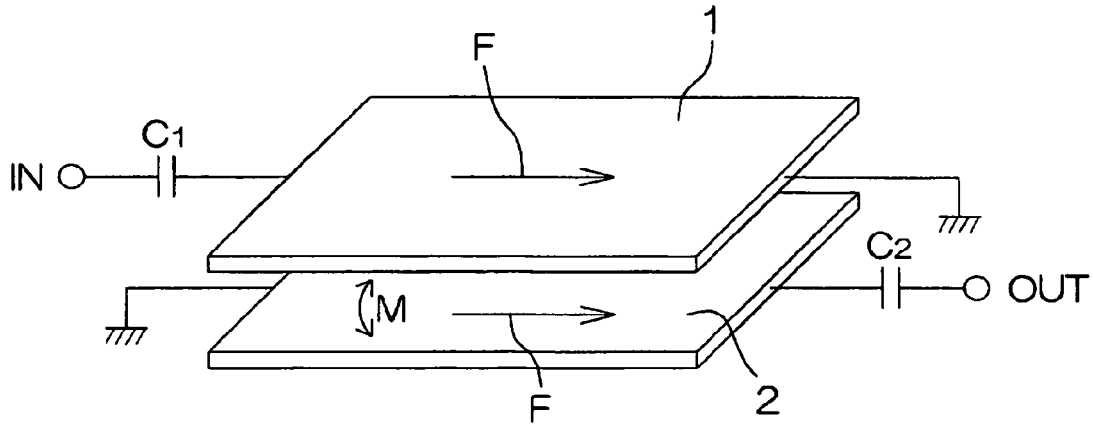
FIG. 2 is an illustrative view showing another circuit configuration example of a bandpass filter according to the present invention.

FIG. 2 is an illustrative view showing another circuit configuration example of a bandpass filter. This circuit configuration differs from that shown in FIG. 1 in that the input direction F is the same as the output direction F (input and output ends are positioned on opposite sides when viewed in the laminating direction). Therefore, the grounded ends of the resonators 1 and 2 are positioned on opposite sides when viewed in the laminating direction.

The above structure can widen the pass band and achieve size reduction as is the case with that shown in FIG. 1, and since the grounded ends are positioned alternately, the resonators 1 and 2 can be coupled more strongly to each other than in the structure shown in FIG. 1, which can advantageously achieve a further wider band (as will be described hereinafter while comparing data in a practical example).

Figure 3:
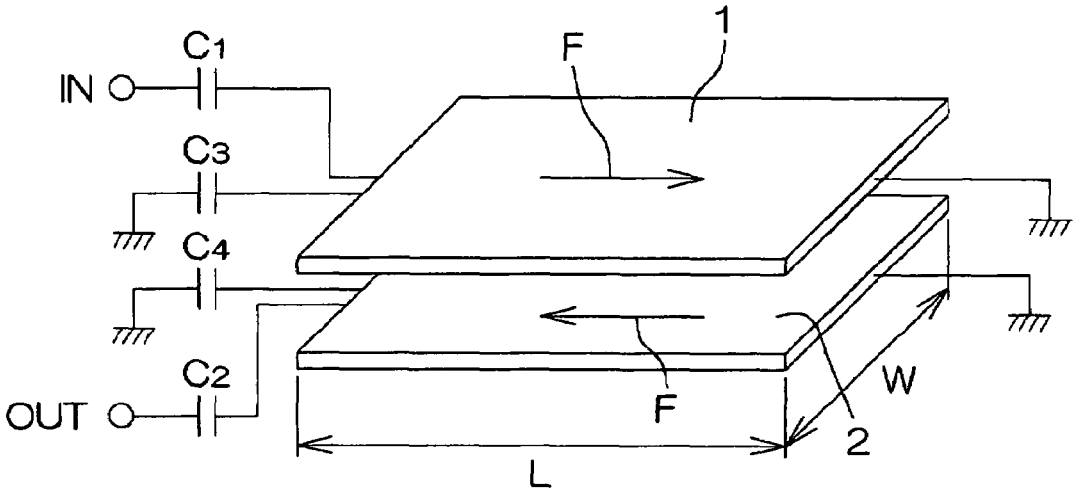
FIG. 3 is an illustrative view showing still another circuit configuration example of a bandpass filter according to the present invention.

FIG. 3 is an illustrative view showing still another circuit configuration example of a bandpass filter. One ends (input and output ends) of the resonators 1 and 2 are coupled electromagnetically to input and output electrodes IN and OUT, respectively, via capacitor elements C1 and C2, and the input and output ends of the resonators are grounded, respectively, via capacitor elements C3 and C4. The sides (end portions on the right in FIG. 3) opposite those coupled to the input and output ends form grounded ends.

In the circuit configuration above, the input direction F and the output direction F in the respective resonators 1 and 2 differ from each other, as is the case in FIG. 1.

However, the above structure differs from that shown in FIG. 1 in that the open ends are grounded via the capacitor elements C3 and C4. This replaces the effective length of the resonators 1 and 2 partially with the capacitor elements C3 and C4, whereby the length of the resonators 1 and 2 (in the signal propagation direction) can be reduced below λ/4, which represents the length of the resonators shown in FIG. 1.

Figure 4:
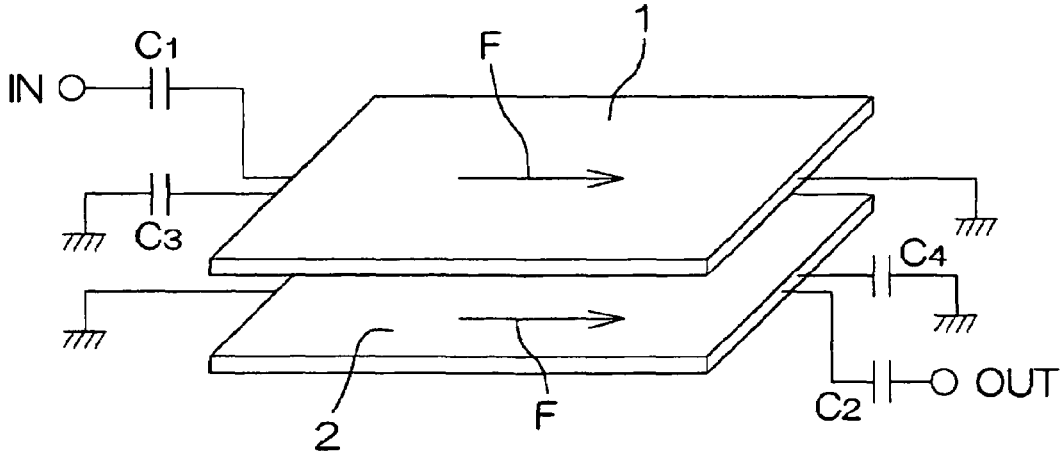
FIG. 4 is an illustrative view showing a further circuit configuration example of a bandpass filter according to the present invention.

FIG. 4 is an illustrative view showing a further circuit configuration example of a bandpass filter. The open ends of the resonators 1 and 2 are coupled electromagnetically to the input and output electrodes IN and OUT, respectively, via the capacitor elements C1 and C2, and the open ends are grounded, respectively, via the capacitor elements C3 and C4.

In the above structure, the open ends of the resonators 1 and 2 are positioned on opposite sides. This shows the same structure as that shown in FIG. 2 where the open ends are grounded via the capacitor elements C3 and C4. This arrangement also replaces the effective length of the resonators 1 and 2 partially with the capacitor elements C3 and C4, whereby the length of the resonators 1 and 2 (in the signal propagation direction) can be reduced below $\lambda/4$. It is therefore possible to achieve size reduction as is the case in FIG. 3, and to achieve a wider band relative to the structure shown in FIG. 1. Further, in accordance with this structure, it is possible to shift higher modes toward the higher-frequency side, resulting in an improvement in out-of-band characteristics as will be shown by data in a practical example to be described hereinafter.

In the structures in FIGS. 1 to 4 as described heretofore, although the input and output electrodes IN and OUT are connected to the input and output ends (open ends) of the resonators 1 and 2 via the capacitor elements C1 and C2 or inductor elements, input and output lines coupled to the resonators 1 and 2 may be used instead of the capacitor elements or inductor elements.

The input and output lines each may employ a structure of including a strip line, a microstrip line, or a coplanar line. These lines each form a broadside coupling with respect to the respective resonators 1 and 2.

Figure 5:
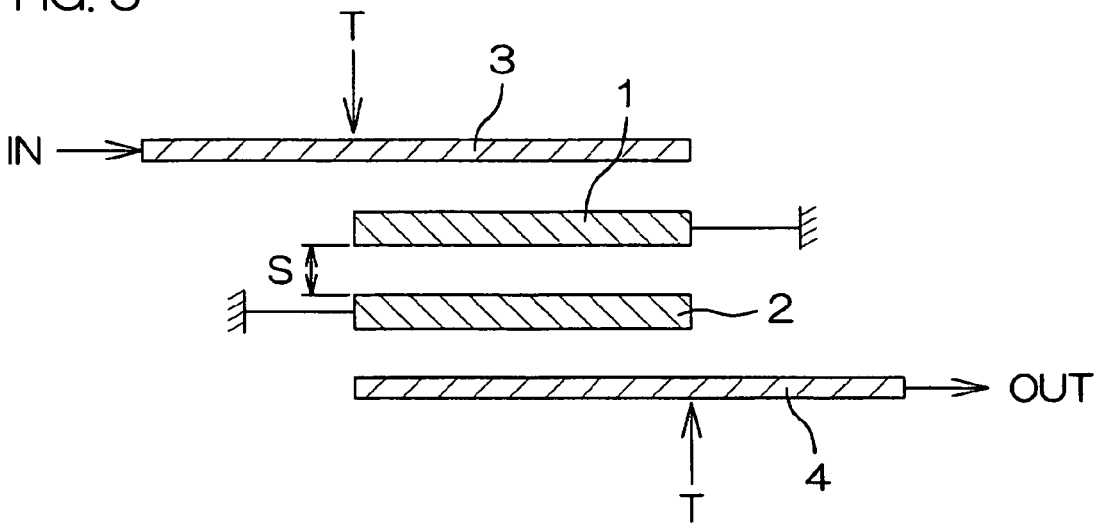
FIG. 5 is a cross-sectional view showing a structural example of a bandpass filter according to the present invention in which input and output lines 3 and 4 are used as input and output parts.

For example, FIG. 5 is an illustrative view showing the cross-section of a bandpass filter that employs a structure of including the input and output lines 3 and 4 coupled to the resonators 1 and 2 as input and output parts.

In accordance with the structure thus using the input and output lines 3 and 4, there is no need to arrange, for example, chip parts of a capacitor or inductor element on the upper surface of the dielectric substrates, which can reduce the number of parts and thereby reduce the height of the bandpass filter. Also, the input and output lines 3 and 4 can be formed on the dielectric layers at the same time as, where appropriate, forming other conductor patterns, which cannot cause the number of manufacturing processes to be increased.

Figure 6:
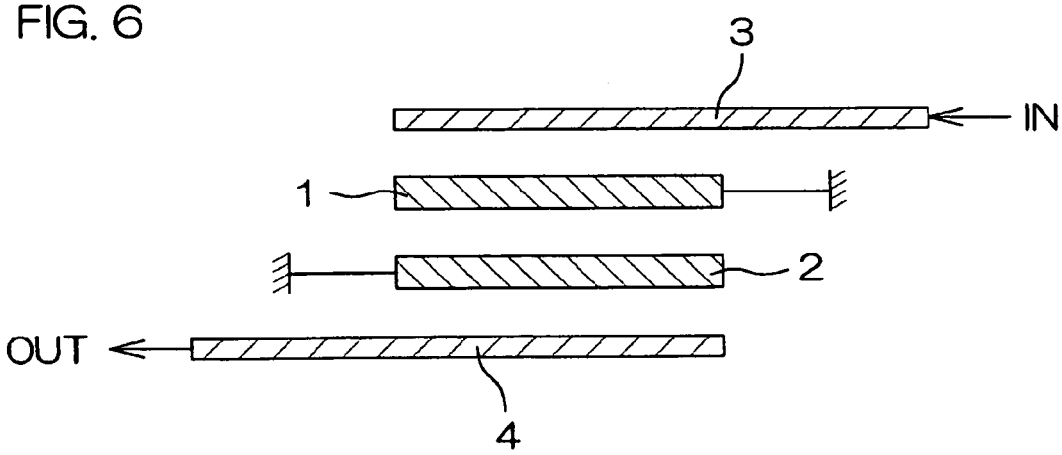
FIG. 6 is a cross-sectional view showing another structural example of a bandpass filter according to the present invention in which input and output lines 3 and 4 are used as input and output parts.

FIG. 6 is an illustrative view showing the cross-section of another bandpass filter that employs a structure of including the input and output lines 3 and 4 coupled to the resonators 1 and 2 as input and output parts. This structure differs from that shown in FIG. 5 in that the input direction to the input line 3 coincides with the direction toward the open end of the resonator 1, which is opposite the input direction shown in FIG. 5. Also, the output direction from the output line 4 coincides with the direction toward the grounded end of the resonator 2, which is opposite the output direction shown in FIG. 5.

Figure 7:
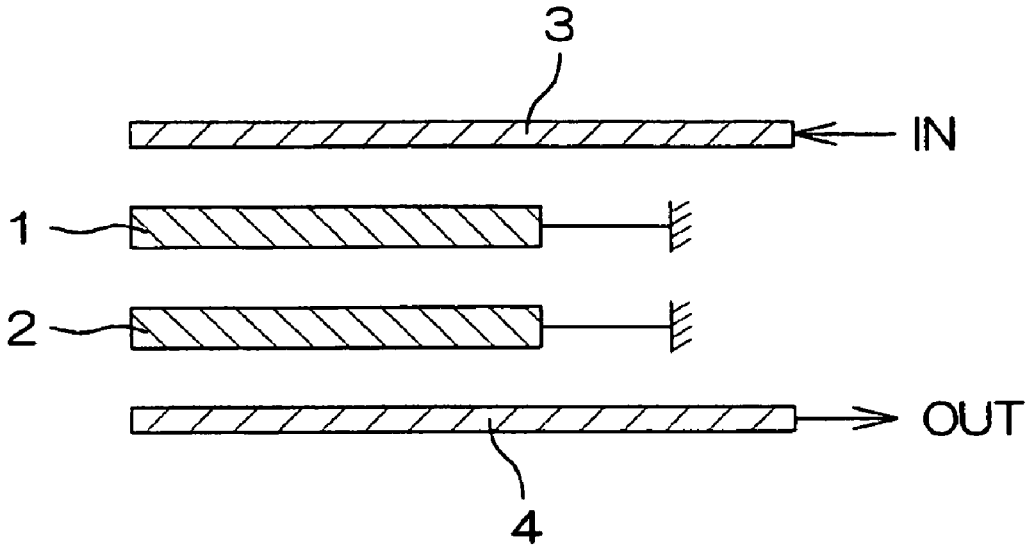
FIG. 7 is a cross-sectional view showing still another structural example of a bandpass filter according to the present invention in which input and output lines 3 and 4 are used as input and output parts.

FIG. 7 is an illustrative view showing the cross-section of still another bandpass filter that employs a structure of including the input and output lines 3 and 4 coupled to the resonators 1 and 2 as input and output parts. In this structure, the grounded ends of the resonators 1 and 2 are arranged on the same side (on the right in the figure) of the resonators 1 and 2, unlike the cases in FIGS. 5 and 6. Also, the input direction to the input line 3 and the output direction from the output line 4 are opposite each other.

Figure 8:
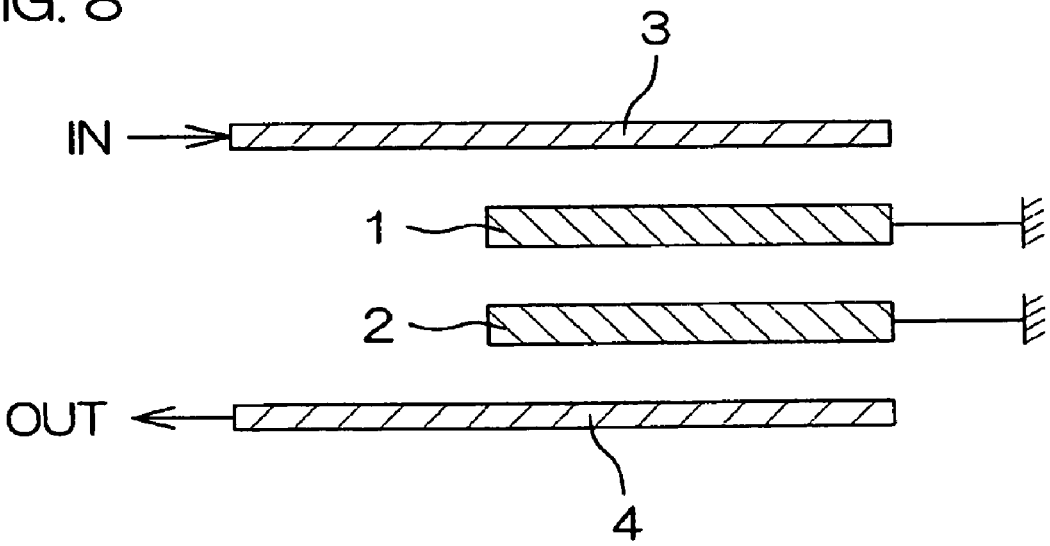
FIG. 8 is a cross-sectional view showing a further structural example of a bandpass filter according to the present invention in which input and output lines 3 and 4 are used as input and output parts.

FIG. 8 is an illustrative view showing the cross-section of a further bandpass filter that employs a structure of including the input and output lines 3 and 4 coupled to the resonators 1 and 2 as input and output parts. In the structure shown in FIG. 8, the grounded ends of the resonators land 2 are arranged on the same side (on the right in the figure) of the resonators 1 and 2, as is the case in FIG. 7. This structure differs from that shown in FIG. 7 in that in FIG. 7, the input and output ends IN and OUT of the bandpass filter are on the same side as the grounded ends of the resonators 1 and 2, while in FIG. 8, on the opposite side. Thus, the signal input and output ends IN and OUT can be arranged on the opposite side to the grounded ends.

As described heretofore, in accordance with the embodiments shown in FIGS. 5 to 8, since it is possible to use lines such as strip lines coupled to the resonators 1 and 2 for signal input and output, there is no need to use a lumped constant element, which can reduce the size and facilitate the manufacturing of the filter. In addition, since the input and output ends and the grounded ends of the resonators can be positioned selectively as shown in FIGS. 5 to 8, it is possible to freely address limitations in circuit design if existing.

It is noted that if lines such as strip lines are used for signal input and output, the width of the input or output line is preferably formed stepwise at the end (indicated by T in FIG. 5) of a portion overlapping the resonators 1 and 2 when viewed in the laminating direction. The specific configurations of the above-described bandpass filters will hereinafter be described in detail with reference to FIG. 11 and the following figures.

The N ($N \geqq 2$) resonators in the foregoing bandpass filters are formed by laminating a plurality of conductor patterns and dielectric layers alternately, for example, by laminating a plurality of dielectric layers with predetermined conductor patterns formed on the respective upper surfaces thereof.

Each dielectric layer is formed using, for example, LTCC (Low Temperature Co-fired Ceramics), and each conductor pattern is formed on each dielectric layer using a low-resistance conductor such as copper or silver. In particular, using a dielectric material having a high dielectric constant can reduce the size of the bandpass filter.

Such a multilayer substrate in which a plurality of conductor patterns and dielectric layers are laminated alternately will be formed by a well-known multilayer ceramic technique. For example, after applying conductive paste on the surfaces of ceramic green sheets to form conductor patterns that each constitutes a resonator, the sheets are laminated and thermally compressed at a required pressure and temperature to be fired. It is noted that a via conductor required for connecting conductor patterns vertically will be formed appropriately across a plurality of dielectric layers.

Figure 10:
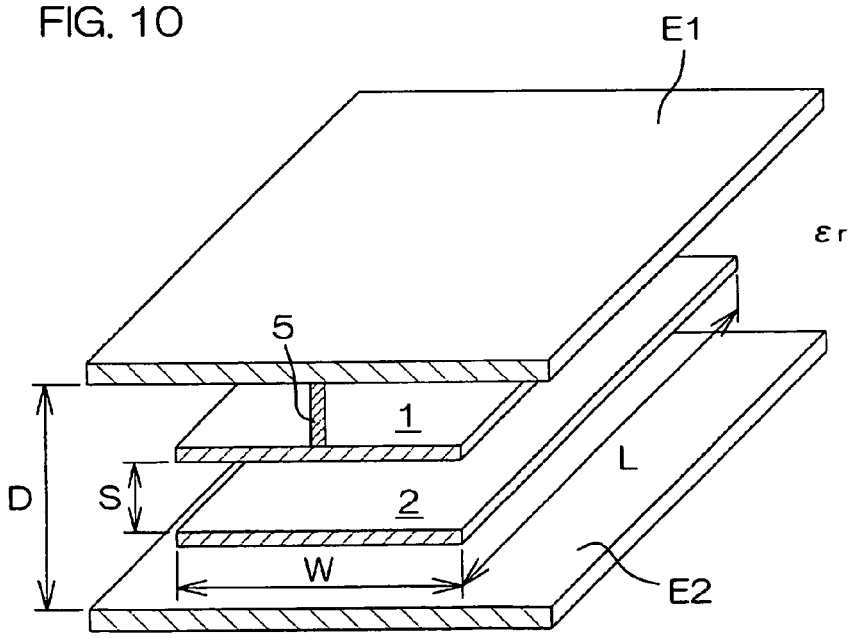
FIG. 10 is a perspective view of the bandpass filter shown in FIG. 9.

FIG. 9 is a cross-sectional view specifically showing a structure where the bandpass filter shown in FIG. 2 is formed inside a dielectric multilayer substrate, and FIG. 10 is a perspective view when viewed from the A-A end section, showing the arrangement of conductor patterns in the bandpass filter (dielectric layers are not shown in the figure).

Among multiple dielectric layers (three layers or more) formed, second layers G1 adjacent to each other are formed, respectively, with conductor patterns A1 and A2 that constitute resonators 1 and 2, and layers G2 on and under the second layers are formed with grounding patterns E1 and E2 as grounding conductors for grounding the end portions of the resonators 1 and 2. Here, it is not always necessary that the layers G1 formed with the conductor patterns A1 and A2 of the resonators 1 and 2 and the layers G2 formed with the grounding pattern E1 and E2 be adjacent to each other vertically (may be separated from each other by two layers or more).

The grounding pattern E1 and E2 and the conductor patterns A1 and A2 of the resonators 1 and 2 are connected to each other at the grounded ends of the resonators 1 and 2 via via conductors 5 and 6 penetrating through the dielectric layers. Thus, the resonators 1 and 2 are grounded at the grounded ends.

It is noted that the input end of the resonator 1 (or the input end of the resonator 2) is connected to a pad 10 (11) that is formed on the top dielectric layer (i.e. on the principal surface of the dielectric substrate) via a via conductor 8 (7). The pad 10 (11) is connected with a chip-shaped lumped constant capacitor element C1 (C2).

As is the case with the input end, the output end of the resonator 2 (or the output end of the resonator 1) is also connected to a pad 11 (10) that is formed on the principal surface of the top dielectric layer via a via conductor 7 (8). The pad 11 (10) is connected with a chip-shaped lumped constant capacitor element C2 (C1).

Although the foregoing descriptions are made using the cross-sectional and perspective views for the bandpass filter shown in FIG. 2, the bandpass filter in FIG. 1 also can basically employ the same structure, with a difference in the positions of the input and output ends and the grounded ends of the resonators 1 and 2. Then, in the bandpass filters shown in FIGS. 3 and 4, the resonators land 2 are connected with the capacitor elements C3 and C4, where the capacitor elements C3 and C4 can also be connected to grounding patterns E1 and E2 via via conductors, as is the case with the descriptions for FIGS. 9 and 10.

Here will be described a specific example of a structure where such a bandpass filter using the input and output lines as shown in FIGS. 5 to 8 is formed inside a dielectric multilayer substrate.

The bandpass filters shown in FIGS. 5 to 8 employ a structure of including the input and output lines 3 and 4 coupled to the resonators 1 and 2 as input and output parts. In the bandpass filters shown in FIGS. 5 to 8, the end portions of the resonators 1 and 2 sandwiched between the input and output lines 3 and 4 are required to be grounded.

Hence, there can be employed a structure, for example, where grounding conductors (grounding patterns) for grounding the end portions of the resonators 1 and 2 are provided in the respective dielectric layers on and under the conductor patterns that constitute the resonators 1 and 2 and the input and output lines 3 and 4, or provided in the same layers as the dielectric layers formed with the respective resonators 1 and 2.

FIGS. 11 to 14 show specific examples where grounding conductors (grounding patterns E1 and E2) for grounding the end portions of resonators 1 and 2 are provided in the same dielectric layers as the respective resonators 1 and 2.

Figure 11:
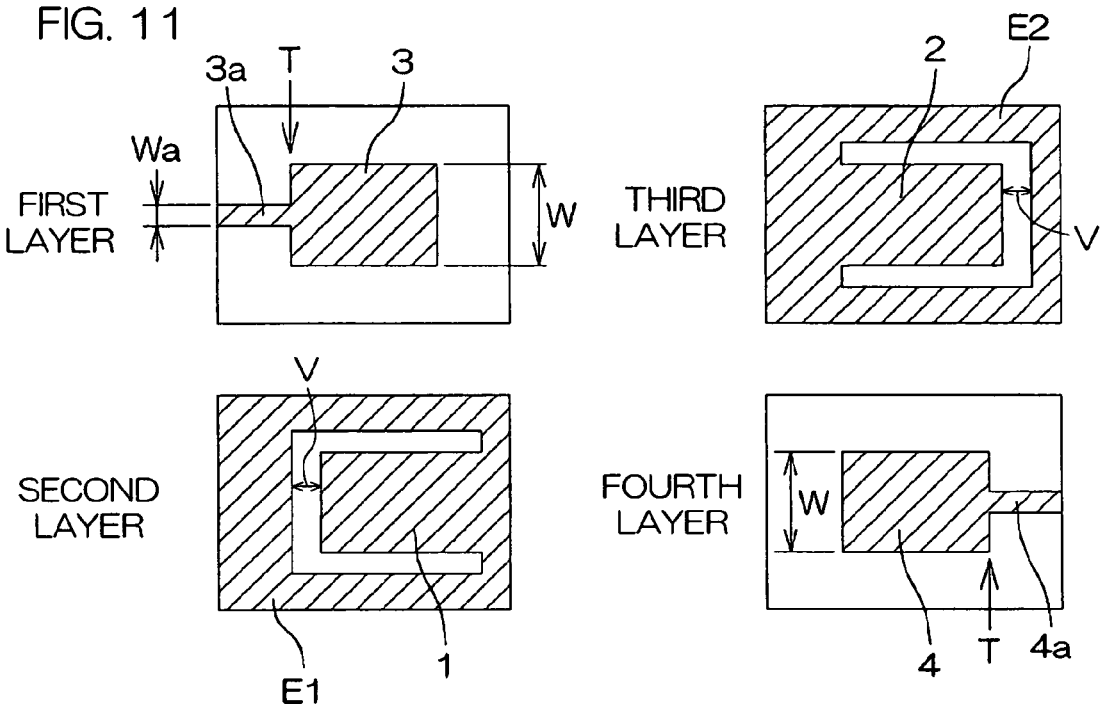
FIG. 11 is an illustrative view showing the conductor pattern of each layer of the bandpass filter shown in FIG. 5.

FIG. 11 is a plan view showing, in a disassembled manner, a dielectric layer (first layer) provided with an input line 3, dielectric layers (second and third layers) provided, respectively, with the resonators land 2, and a dielectric layer (fourth layer) provided with an output line 4. The laminated structure of the bandpass filter corresponds to that of the bandpass filter described in FIG. 5.

In accordance with the above structure, the second and third layers are provided with conductor patterns with "U"-shaped clearances formed partially therein to form the rectangular resonators 1 and 2, and grounding conductors (grounding patterns E1 and E2) are formed in such a manner as to surround the respective resonators 1 and 2 so that one ends (grounded ends) of the resonators 1 and 2 are only grounded. Here, the "U"-shaped clearances are formed in areas around the respective resonators 1 and 2 and excluding the grounded ends.

The width W of the input line 3 provided in the first layer, the width of the resonator 1 provided in the second layer, the width of the resonator 2 provided in the third layer, and the width W of the output line 4 provided in the fourth layer are all approximately the same. Then, the width W of the input line 3 provided in the first layer is narrowed stepwise at the end (signal input end) T of a portion overlapping the resonators 1 and 2 when viewed in the laminating direction, where the narrowed width is indicated by Wa. As is the case with the first layer, the width W of the output line 4 provided in the fourth layer is narrowed stepwise at the end (signal output end) T of a portion overlapping the resonators 1 and 2 when viewed in the laminating direction. This allows an attenuation pole to be controlled, thus resulting in an advantageous improvement in attenuation characteristics.

As mentioned above, in accordance with the structure shown in FIG. 11, since the resonators 1 and 2 and the grounding conductors (grounding patterns E1 and E2) are provided in the same layers, the end portions of the resonators 1 and 2 can be grounded without connecting the resonators 1 and 2 to a grounding pattern of another layer through a via. This allows the conductor patterns to be formed through a single process, offering the advantage that the number of manufacturing processes cannot be increased to facilitate the manufacturing of the filter.

Figure 12:
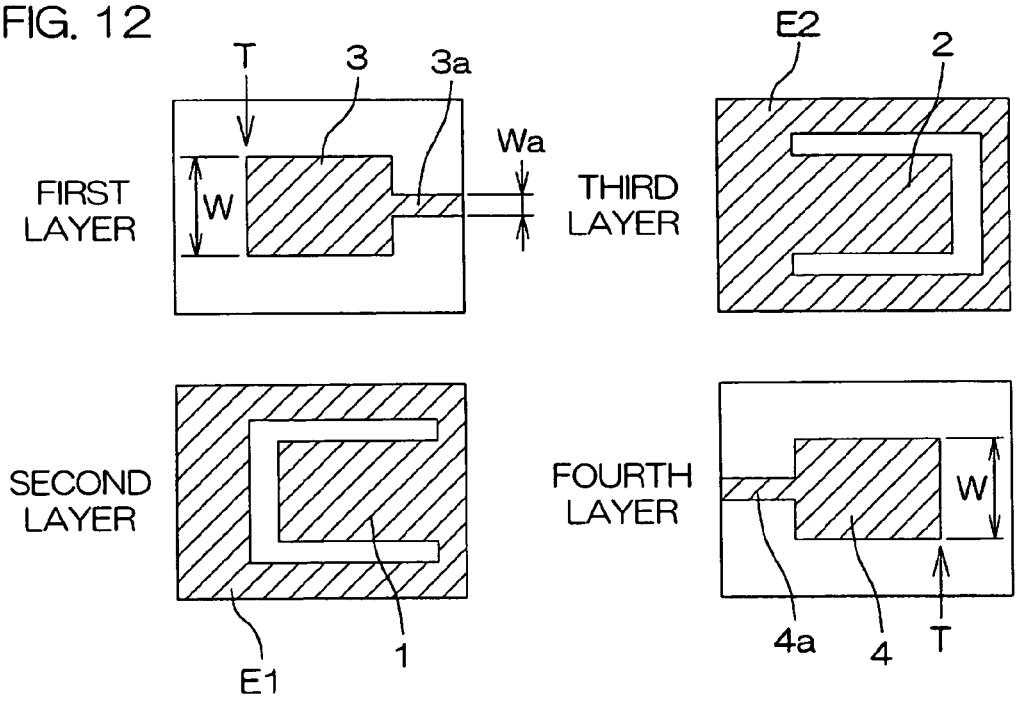
FIG. 12 is an illustrative view showing the conductor pattern of each layer of the bandpass filter shown in FIG. 6.
Figure 13:
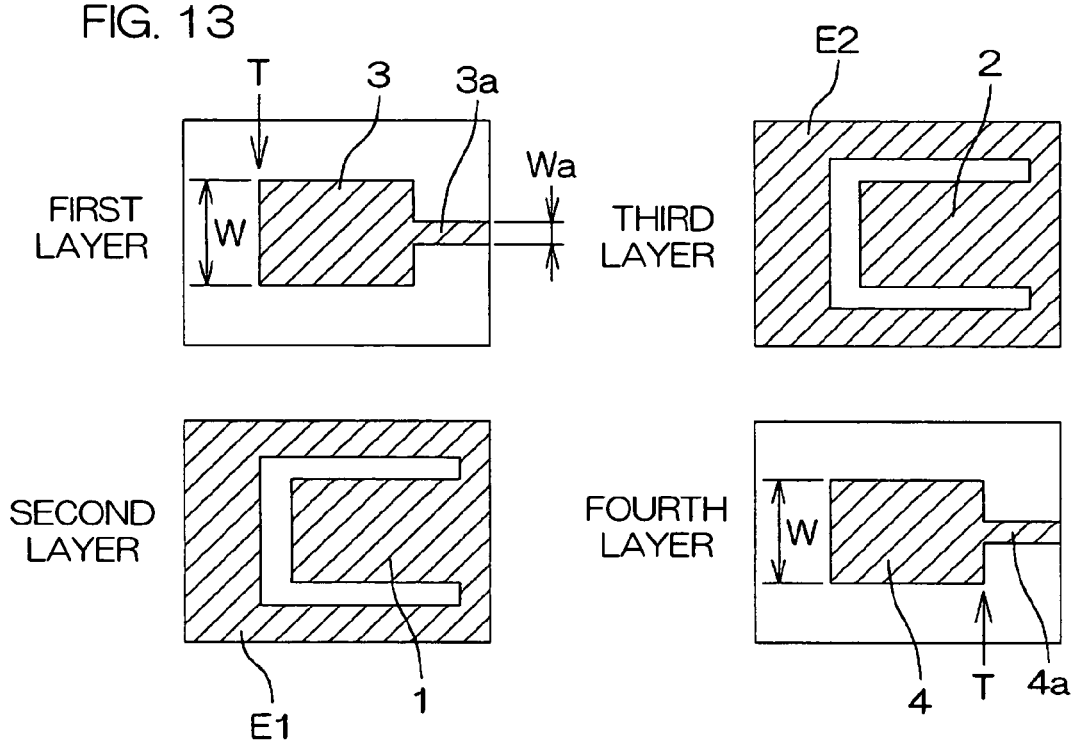
FIG. 13 is an illustrative view showing the conductor pattern of each layer of the bandpass filter shown in FIG. 7.
Figure 14:
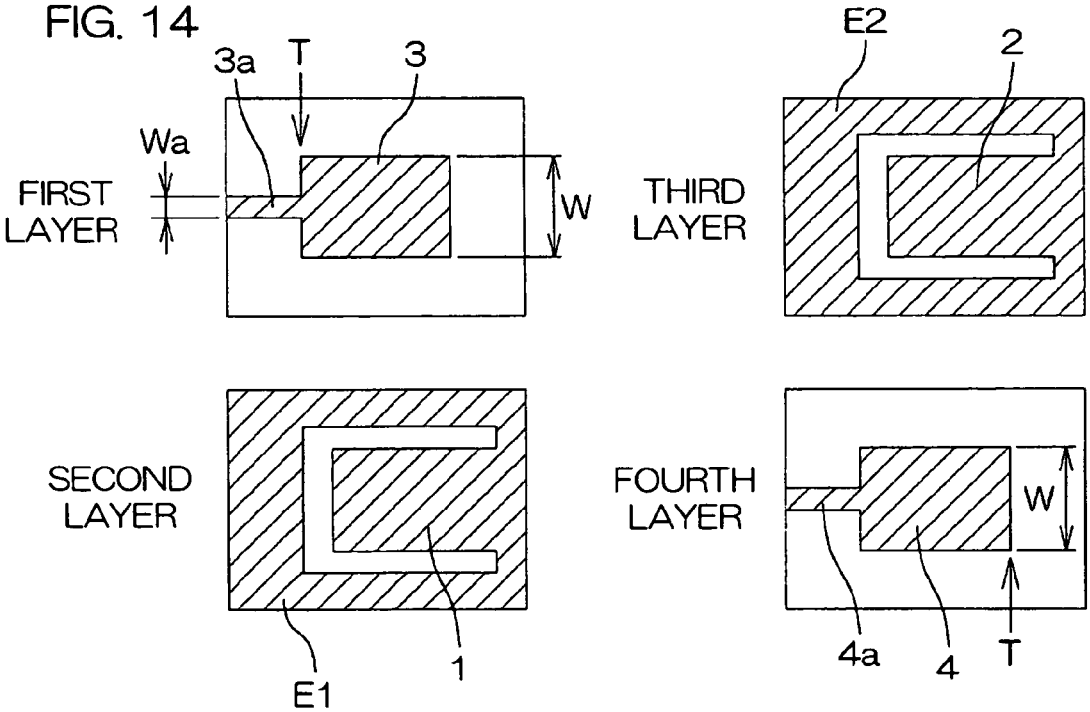
FIG. 14 is an illustrative view showing the conductor pattern of each layer of the bandpass filter shown in FIG. 8.

Also, FIG. 12 shows the laminated structure of a bandpass filter corresponding to that shown in FIG. 6; FIG. 13 shows the laminated structure of a bandpass filter corresponding to that shown in FIG. 7; and FIG. 14 shows the laminated structure of a bandpass filter corresponding to that shown in FIG. 8.

As is the case with the structure shown in FIG. 11, these structures are also arranged in such a manner that the second and third layers are provided with conductor patterns with "U"-shaped clearances formed partially therein to form the rectangular resonators 1 and 2, and grounding patterns E1 and E2 are formed in such a manner as to surround the respective resonators 1 and 2 so that one ends (grounded ends) of the resonators 1 and 2 are only grounded. In any of the structures, the resonators 1 and 2 and the grounding patterns E1 and E2 are provided in the same layers, and therefore can be formed at the same time, offering the advantage that the number of manufacturing processes cannot be increased to facilitate the manufacturing of the filter. Also, since the width of the input and output lines 3 and 4 is formed stepwise at the end section T of a portion overlapping the resonators 1 and 2 when viewed in the laminating direction, it is possible to control an attenuation pole, thus resulting in an advantageous improvement in attenuation characteristics.

It is noted that in the structures shown in FIGS. 11 to 14, it is not necessary to take into account the capacitance between the open ends of the resonators and the portions of the grounding conductors near the open ends as long as the width of the "U"-shaped clearances (the distance between the resonators and the grounding patterns, indicated by "V" in FIG. 11) is wide. However, if the width of the clearances is narrow, capacitance is to be formed therebetween to correspond to the arrangement shown in FIG. 15 to be described hereinafter. In this regard, FIG. 15 is an illustrative view assuming a structure of adding capacitance between open ends at the opposite ends to grounded ends of resonators and portions of grounding conductors near the open ends, as will be shown in FIGS. 16 and 17 as specific configurations.

Figure 15:
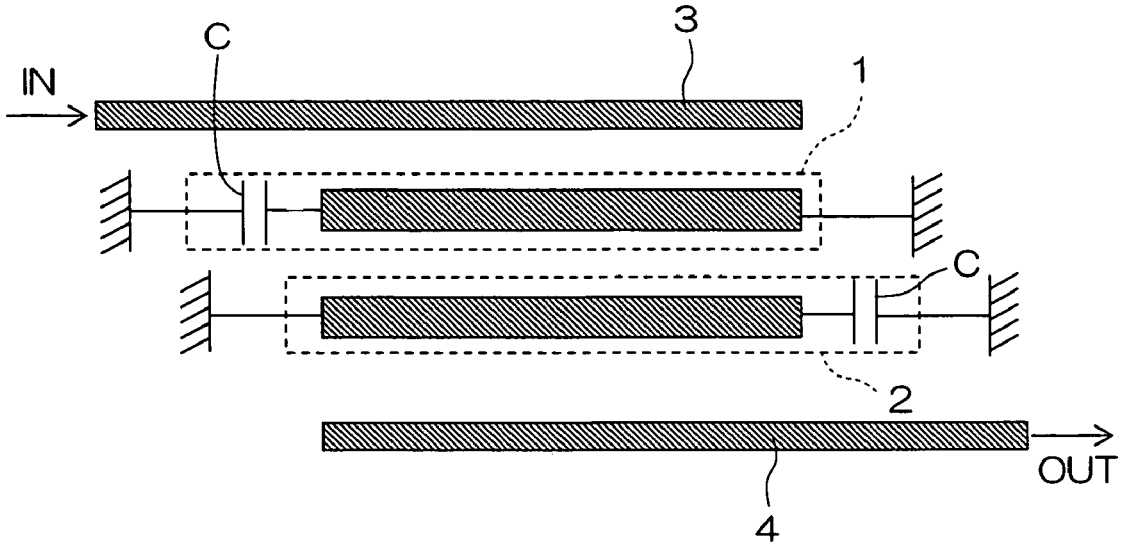
FIG. 15 is an illustrative view showing a circuit configuration example for size reduction and improvement in out-of-band characteristics of a bandpass filter according to the present invention.

FIG. 15 is a cross-sectional view showing the structure of a bandpass filter including resonators 1 and 2 and input and output lines 3 and 4 coupled to the resonators 1 and 2, in which capacitance is added between open ends of the resonators 1 and 2 and grounding conductors.

Figure 38:
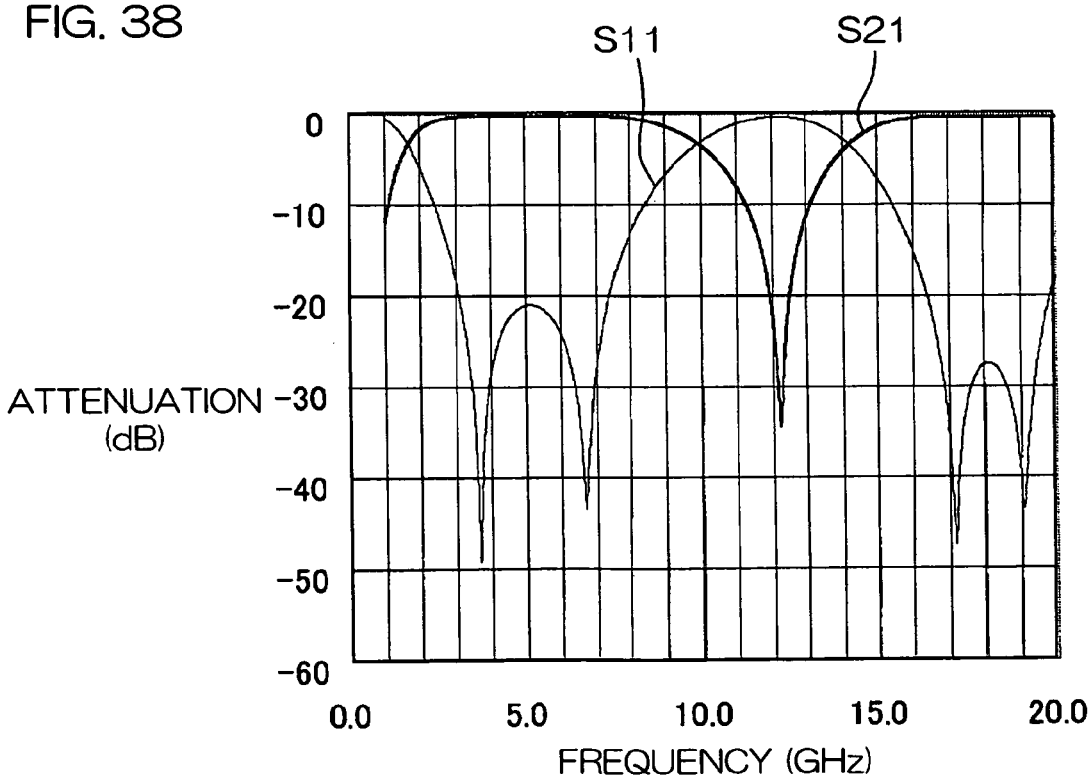
FIG. 38 is a graph showing the transmission characteristics S21 and the reflection characteristics S11 of the bandpass filter shown in FIG. 3 calculated using the simulation software.

In addition to the structure in FIG. 5, the structure shown in FIG. 15 is arranged in such a manner that the open ends of the resonators 1 and 2 are further grounded via capacitor elements C. This arrangement replaces the effective length of the resonators 1 and 2 partially with the capacitor elements C, whereby the length of the resonators 1 and 2 in the signal propagation direction can be reduced below λ/4. Also, it is possible to shift higher modes toward the higher-frequency side, resulting in an improvement in out-of-band characteristics as will be shown by data in a practical example to be described hereinafter. Specifically, as shown in FIG. 38, although the insertion loss S21 as one of the four-terminal parameters cannot be attenuated around 14 GHz due to higher modes (3λ/4 mode in this case), using the above structure can shift the higher modes toward the higher-frequency side to improve the out-of-band S21 characteristics. It is noted that such a method of adding capacitance is also applicable to the structures shown in FIGS. 5 to 8.

Figure 16:
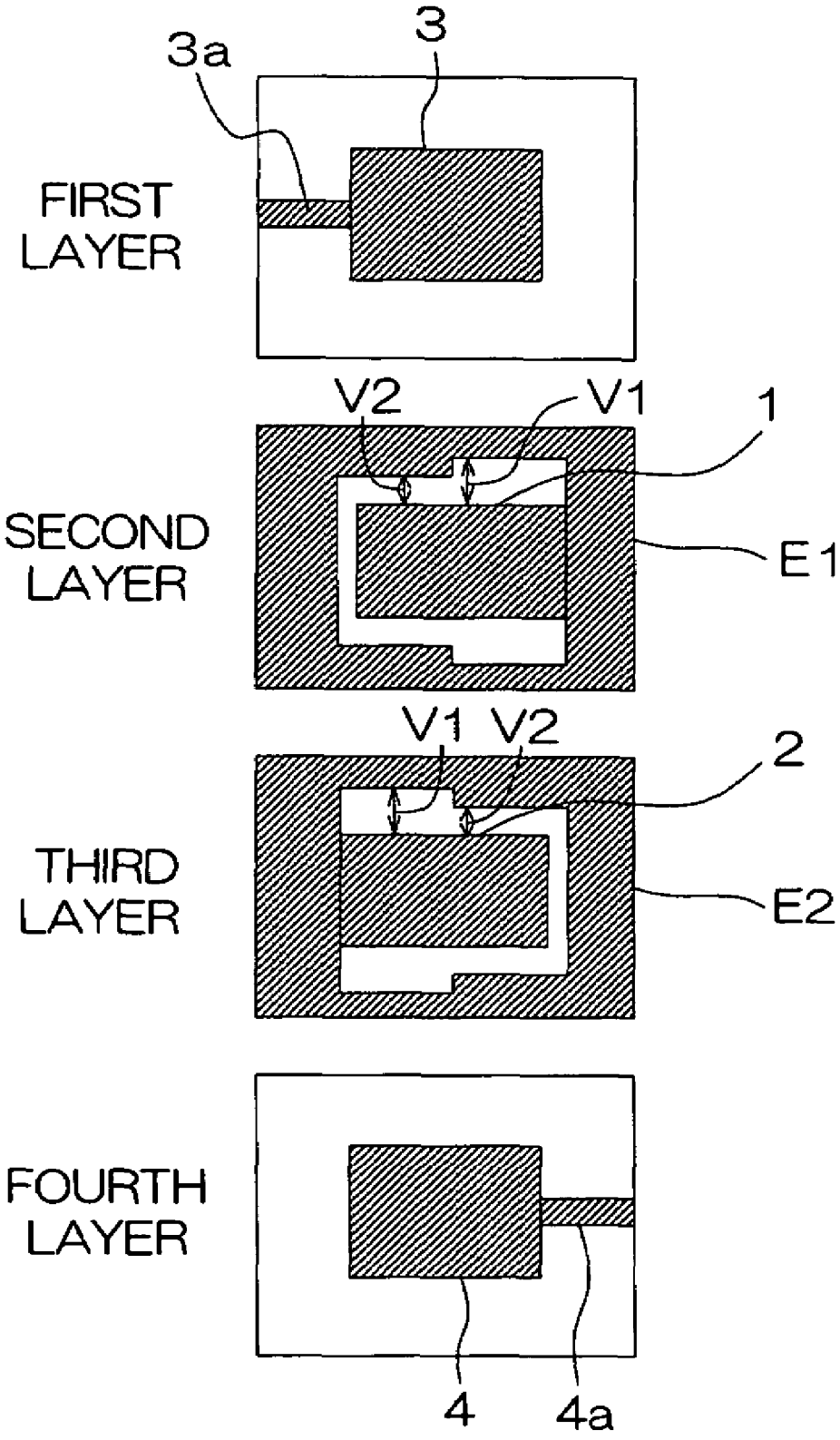
FIG. 16 is an illustrative view showing a conductor pattern example of each layer of the bandpass filter shown in FIG. 15.

As such a configuration of adding capacitance, there can specifically be cited a structure, as shown in FIG. 16, where the width of grounding patterns E1 and E2 is formed stepwise so that the width of "U"-shaped clearances that are formed in areas around the respective resonators 1 and 2 and excluding the grounded ends is formed in a narrowing manner from V1 down to V2 at portions nearer the open ends.

In accordance with the above structure, since capacitance appears at the portions where the width of the clearances is V2, the length of the resonators 1 and 2 in the signal propagation direction can be further reduced relative to the structure shown in FIG. 11. Also, it is possible to shift higher modes toward the higher-frequency side, resulting in an improvement in out-of-band characteristics. Further, the stepwise structure of the grounding patterns E1 and E2 can increase the Q-value of the resonators by increasing the width V1 of the clearances between the grounded ends side of the resonators and the grounding patterns.

Figure 17:
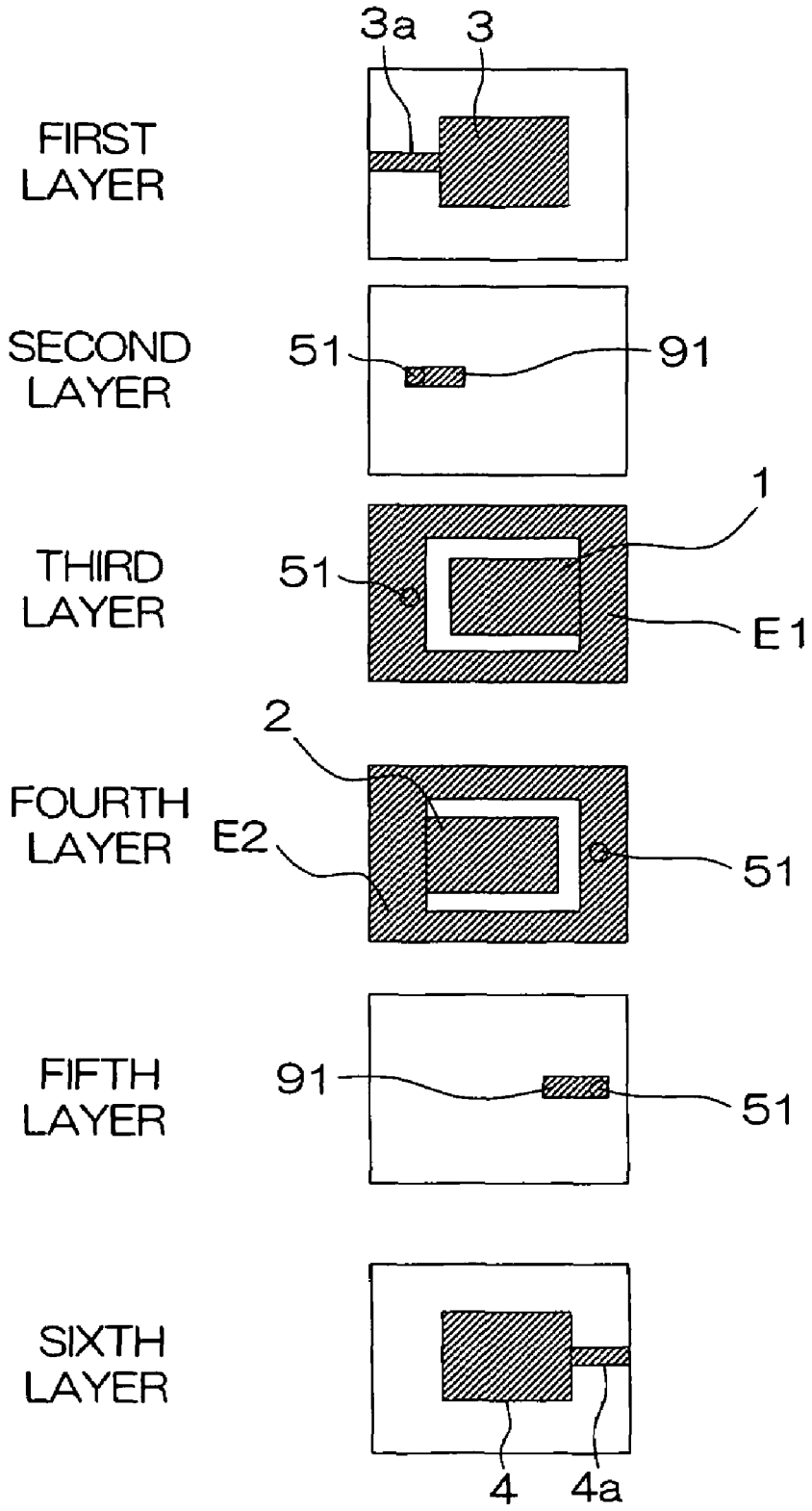
FIG. 17 is an illustrative view showing another conductor pattern example of each layer of the bandpass filter shown in FIG. 15.

As such a configuration of adding capacitance, there can also be cited a structure, as shown in FIG. 17, where capacitance is formed in the laminating direction with respect to the laminated structure of the bandpass filter shown in FIG. 11.

More concretely, first conductors 91 are provided near the upper or lower side of open ends in the resonator 1, and via conductors 51 for connecting the first conductors 91 and grounding conductors (grounding patterns E1 and E2) are provided, so that capacitance is formed between the resonators 1 and 2 and the first conductors 91. In accordance with this structure, it is possible to achieve capacitance greater than in the case of being formed in the same plane, which therefore can further reduce the length of the resonator 1 in the signal propagation direction. Also, it is possible to shift higher modes toward the further higher-frequency side, resulting in an improvement in out-of-band characteristics.

Figure 18:
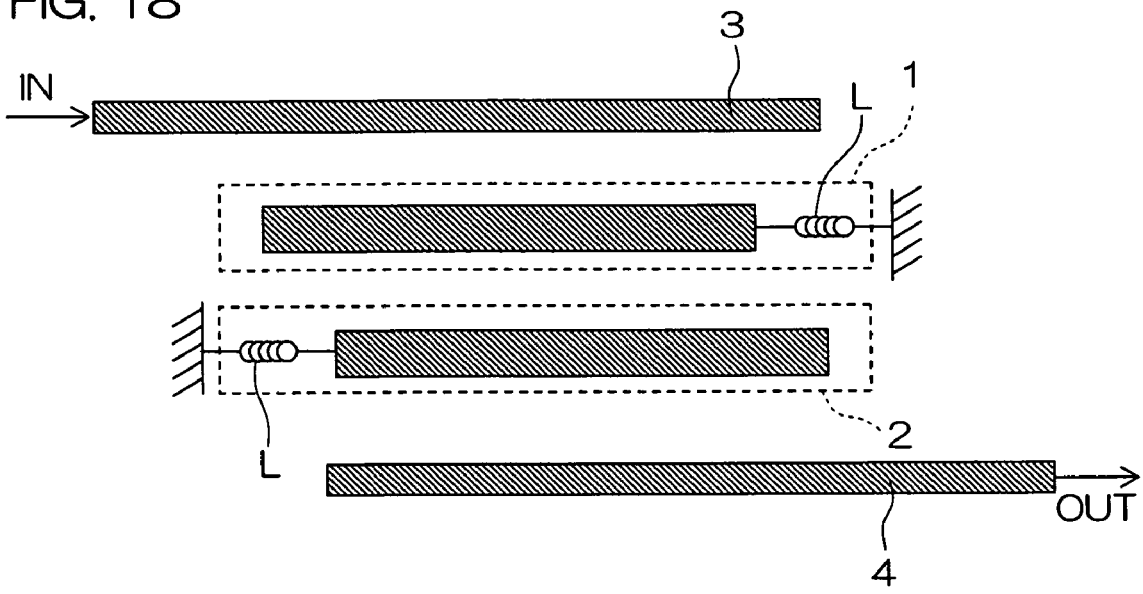
FIG. 18 is an illustrative view showing another circuit configuration example for size reduction and improvement in out-of-band characteristics of a bandpass filter according to the present invention.

FIG. 18 is a cross-sectional view showing the structure of a bandpass filter including resonators 1 and 2 and input and output lines 3 and 4 coupled to the resonators 1 and 2, in which inductance is added to the resonators 1 and 2.

In addition to the structure in FIG. 5, the structure shown in FIG. 18 is arranged in such a manner that, for example, the grounded ends side of the resonators 1 and 2 is narrowed relative to the open ends side thereof when viewed in the laminating direction, so that inductance is added to the grounded ends side of the resonators 1 and 2 (i.e. the resonators are grounded via the inductor elements L). This replaces the effective length of the resonators 1 and 2 partially with the inductor elements L, whereby the length of the resonator 1 in the signal propagation direction can be further reduced relative to the structure shown in FIG. 11. Also, as is the case with the method of adding capacitance as shown in FIG. 15, it is possible to shift higher modes toward the higher-frequency side, resulting in an improvement in out-of-band characteristics. It is noted that such a method of adding inductance is also applicable to the structures shown in FIGS. 5 to 8.

More concretely, the resonators 1 and 2 are formed in a stepwise or continuously narrowing manner toward the grounded ends when viewed in the laminating direction.

Figure 19:
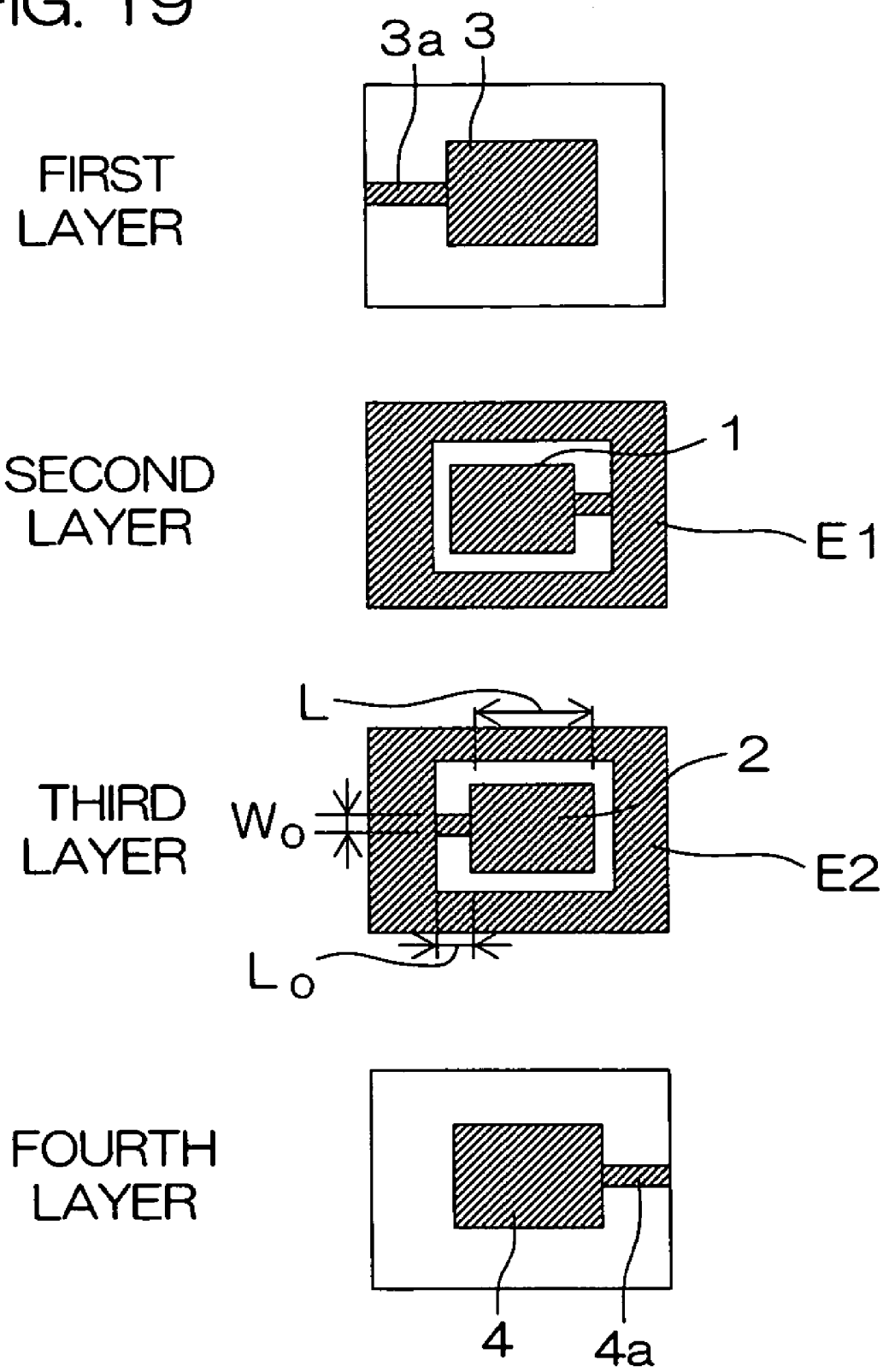
FIG. 19 is an illustrative view showing a conductor pattern example of each layer of the bandpass filter shown in FIG. 18.

For example, the structure shown in FIG. 19 is arranged in such a manner that the resonators 1 and 2 are formed stepwise. In accordance with this structure, it is possible to achieve greater inductance, which therefore can further reduce the length of the resonators 1 and 2 in the signal propagation direction relative to the structure shown in FIG. 11. Also, it is possible to shift higher modes toward the further higher-frequency side, resulting in an improvement in out-of-band characteristics.

It is noted that the structure of adding capacitance and that of adding inductance may be combined and used at the same time.

In the structures described heretofore, since the number of resonators is N=2, the resonators are indicated by numerals 1 and 2. However, FIG. 20 and the following figures show the cases of N≧3. In these cases, resonators will not be identified using references such as "1, 2," and will be integrated to be referred to as "resonator 1."

In embodiments to be described hereinafter, there will be shown the structure of a bandpass filter in which capacitance or inductance is added as electromagnetic coupling means between input and output parts.

Figure 20:
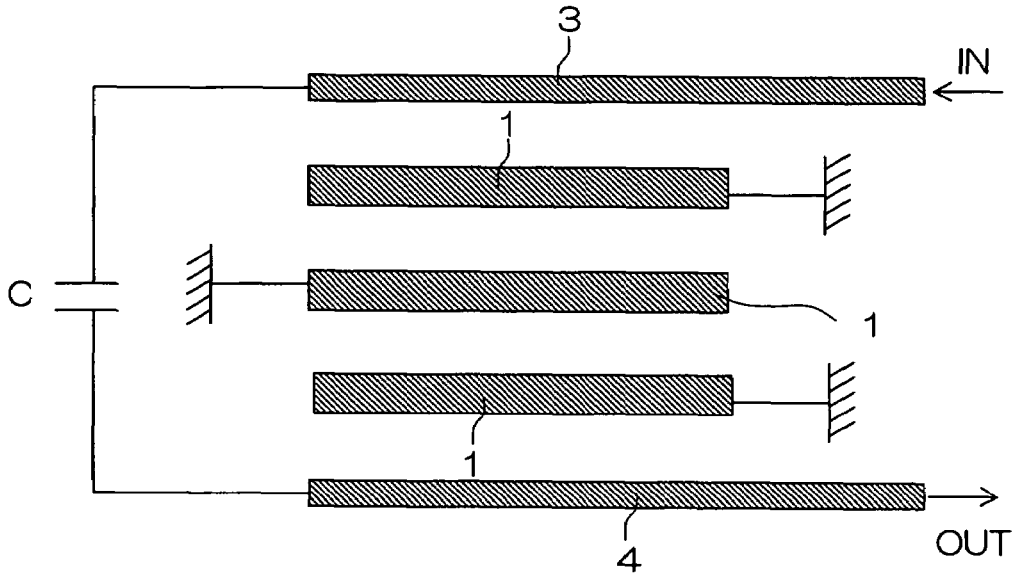
FIG. 20 is an illustrative view showing a circuit configuration example for forming an attenuation pole in a bandpass filter according to the present invention.
Figure 21:
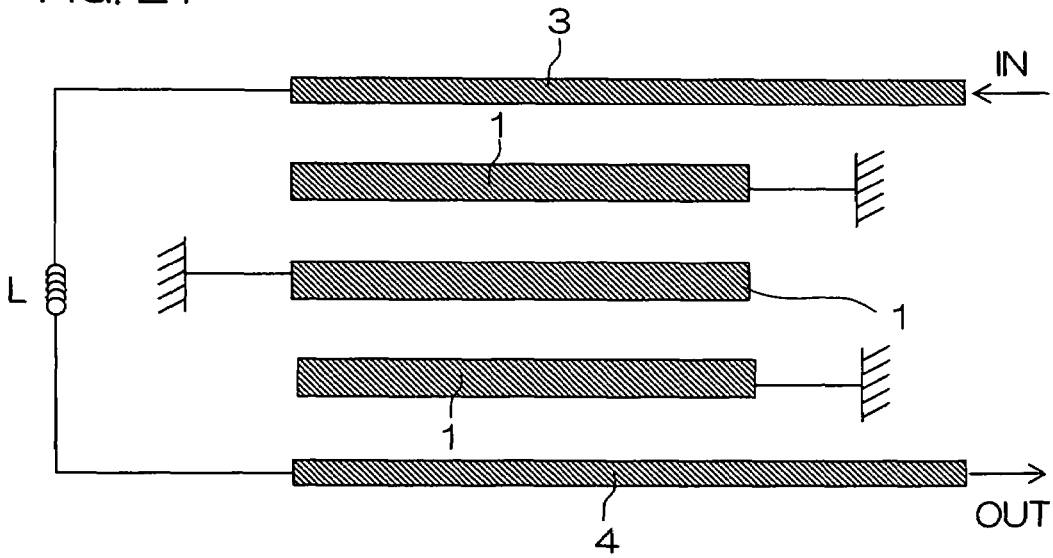
FIG. 21 is an illustrative view showing another circuit configuration example for forming an attenuation pole in a bandpass filter according to the present invention.

FIG. 20 shows a structure where a capacitive coupling jumper is provided between input and output lines 3 and 4. FIG. 21 shows a structure where an inductive coupling jumper is provided between input and output lines 3 and 4.

Thus adding capacitance or inductance between the input and output lines 3 and 4 for electromagnetic coupling allows a new attenuation pole to be formed outside the pass band and near the boundary between the pass band and the out-of-band region, resulting in further steep skirt characteristics.

Figure 22:
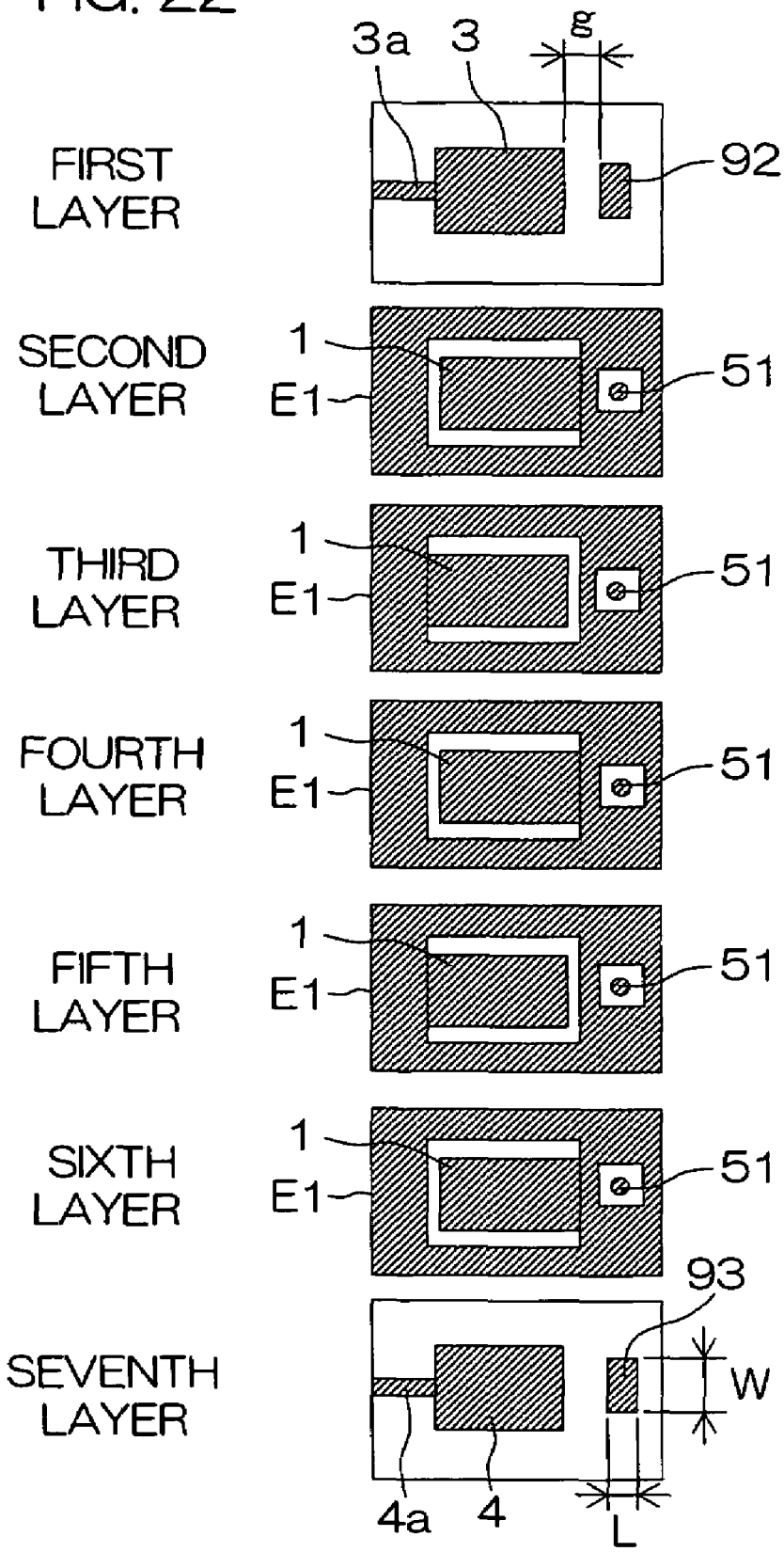
FIG. 22 is an illustrative view showing a conductor pattern example of each layer for forming an attenuation pole in the bandpass filters shown in FIGS. 20 and 21.

To describe the foregoing structure specifically, as shown in FIG. 22, a second conductor 92 is provided in the same plane as the input line 3 and a third conductor 93 is provided in the same plane as the output line 4. A via conductor 51 for connecting the second and third conductors 92 and 93 is further provided.

Since the above structure adds capacitance or inductance between the input and output lines 3 and 4, the input and output lines are coupled electromagnetically to each other to form a circuit configuration that has both capacitance as shown in FIG. 20 and inductance as shown in FIG. 21.

As mentioned above, since the input line 3 and the second conductor 92 are edge-coupled in the same plane and the input line 4 and the third conductor 93 are edge-coupled in the same plane, it is easy to achieve a weak coupling, offering the advantage that it is easy to form an attenuation pole on the higher-frequency side. A simulation result for this structure will hereinafter be shown in FIG. 39.

It is noted that the second and third conductors 92 and 93 are preferably formed in a stepwise or continuously narrowing manner toward the portions connected to the via conductor 51 when viewed in the laminating direction. This structure provides inductance to the second and third conductors 92 and 93 to shift the attenuation pole toward the lower-frequency side easily.

Figure 23:
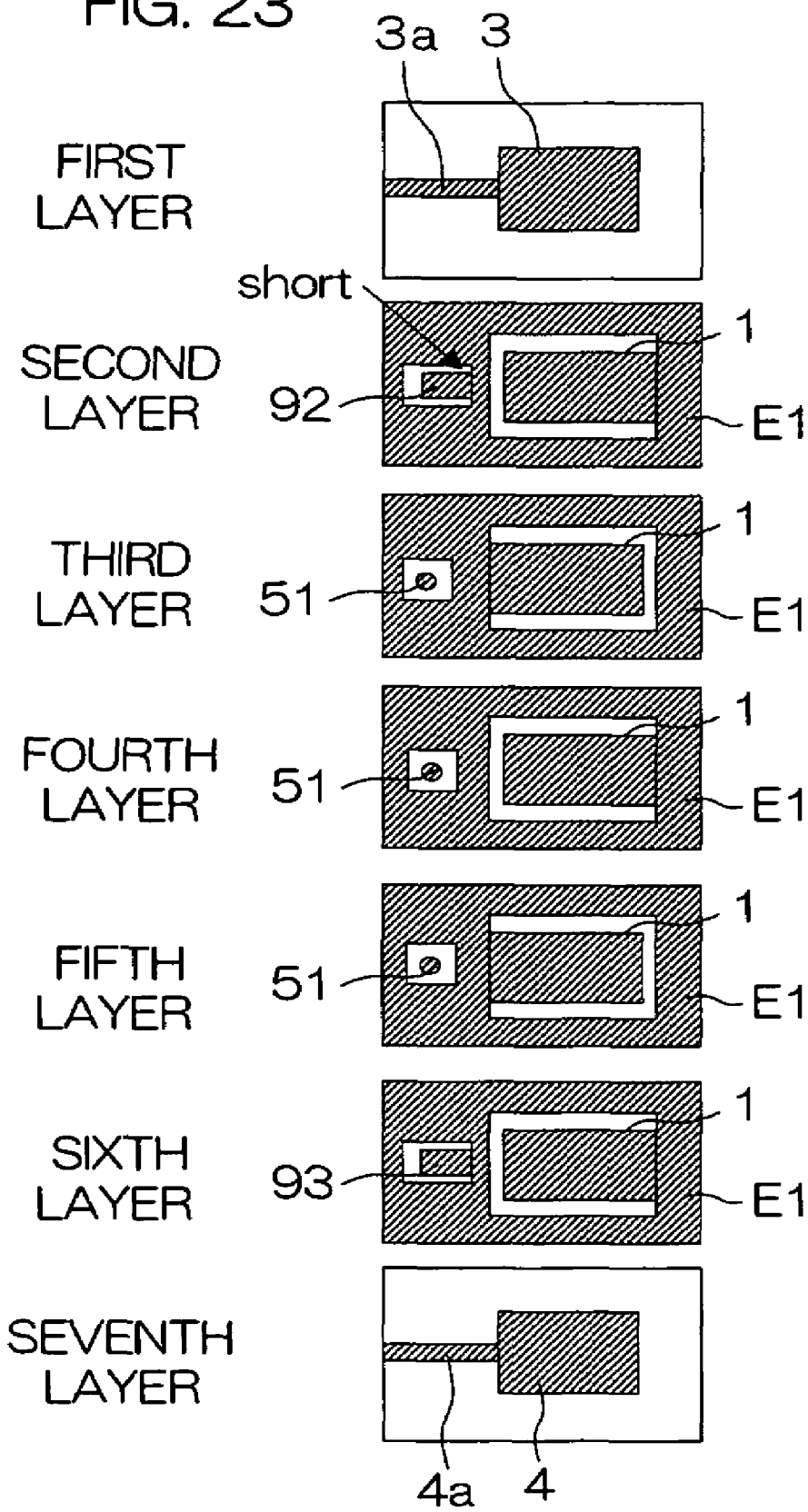
FIG. 23 is an illustrative view showing another conductor pattern example of each layer for forming an attenuation pole in the bandpass filters shown in FIGS. 20 and 21.
Figure 24:
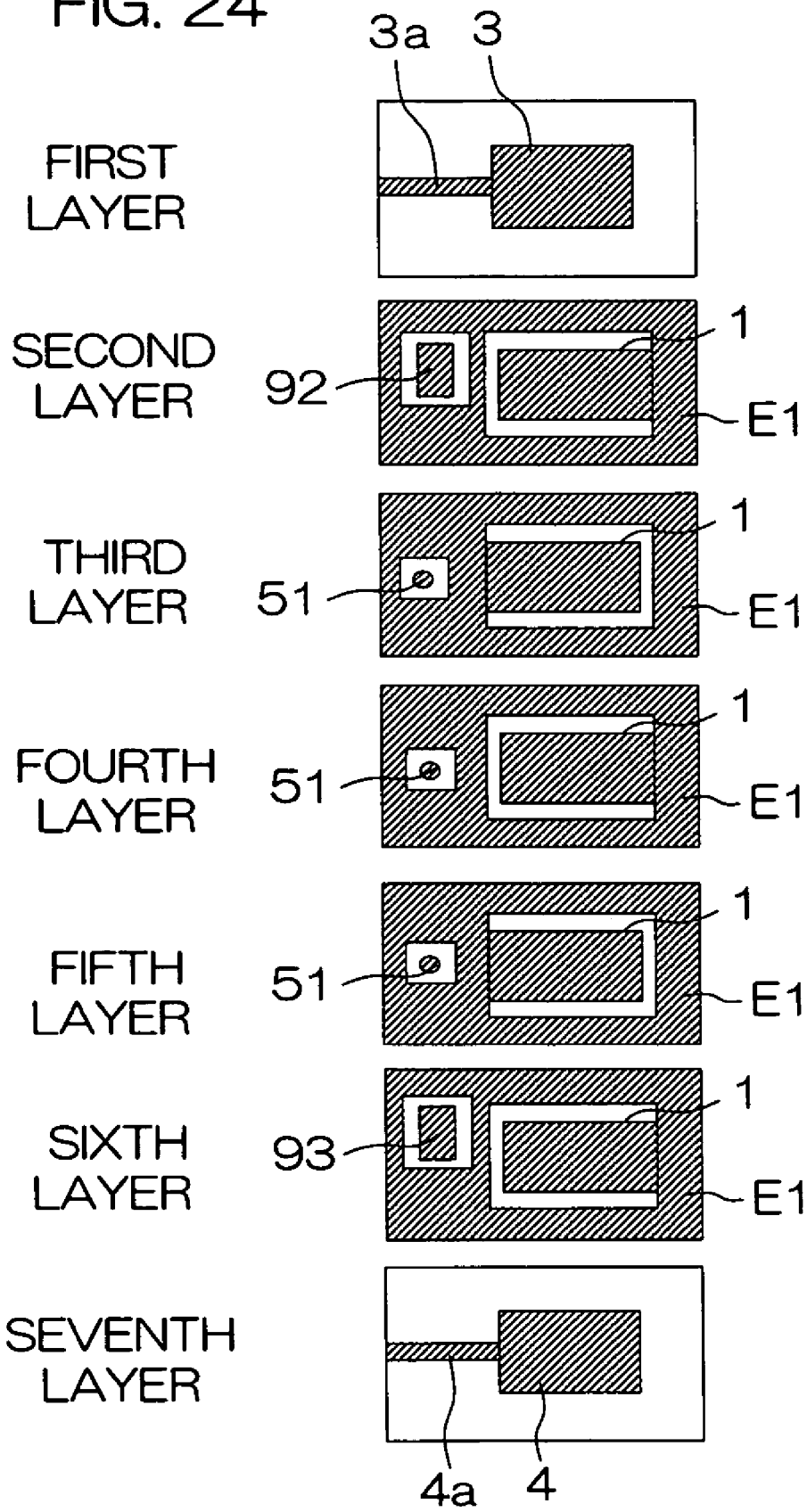
FIG. 24 is an illustrative view showing still another conductor pattern example of each layer for forming an attenuation pole in the bandpass filters shown in FIGS. 20 and 21.

Also, FIGS. 23 and 24 show structures where a second conductor 92 is provided near the lower side of a narrow portion 3*a* of an input line 3 and a third conductor 93 is provided near the upper side of a narrow portion 4*a* of an output line 4, and a via conductor 51 for connecting the second and third conductors 92 and 93 is provided. This structure can add capacitance or inductance as electromagnetic coupling means between the input and output lines 3 and 4. Here, the second conductor 92 is to be coupled to the narrow portion 3*a* of the input line 3, and the third conductor 93 is to be coupled to the narrow portion 4*a* of the output line 4.

It is noted that in the structure shown in FIG. 23, the second and third conductors 92 and 93 are connected to a grounding pattern E1 as a grounding conductor, while in the structure shown in FIG. 24, the second and third conductors 92 and 93 are not connected to a grounding pattern E1 as a grounding conductor to be floated. Any of these structures allows a new attenuation pole to be formed outside the pass band and near the boundary between the pass band and the higher-frequency out-of-band region, resulting in steep skirt characteristics. In particular, the case shown in FIG. 24 can form more attenuation poles than the case shown in FIG. 23, being effective in improving skirt characteristics and out-of-band characteristics.

Figure 25:
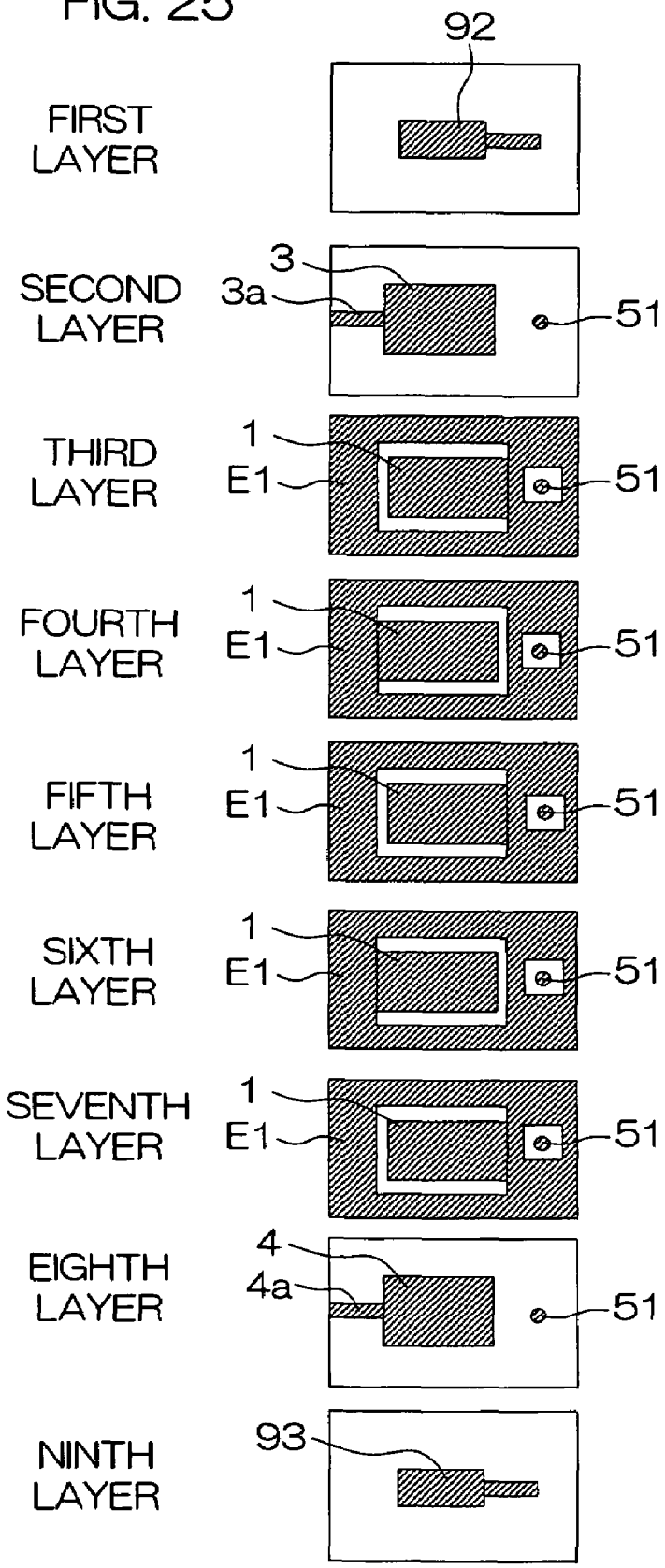
FIG. 25 is an illustrative view showing a further conductor pattern example of each layer for forming an attenuation pole in the bandpass filters shown in FIGS. 20 and 21.
Figure 26:
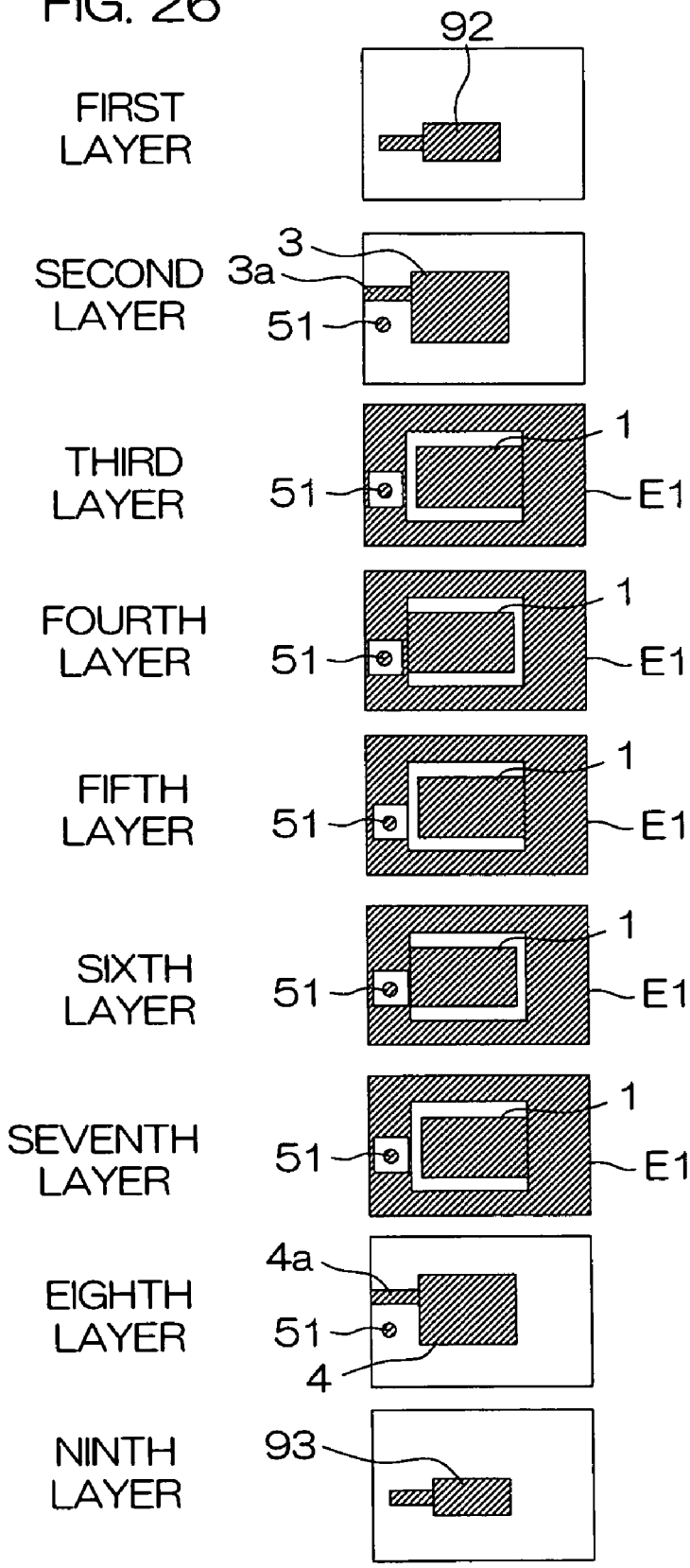
FIG. 26 is an illustrative view showing a still further conductor pattern example of each layer for forming an attenuation pole in the bandpass filters shown in FIGS. 20 and 21.

Also, FIGS. 25 and 26 show structures where a second conductor 92 is provided near the upper side of an input line 3 and a third conductor 93 is provided near the lower side of an output line 4, and a via conductor 51 for connecting the second and third conductors 92 and 93 is provided, so that capacitance or inductance is added between the input and output lines 3 and 4. Here, the second conductor 92 is to be coupled to a wide portion of the input line 3, and the third conductor 93 is to be coupled to a wide portion of the output line 4. This structure offers the advantage that it is easy to form an attenuation pole on the lower-frequency side, unlike the structures shown in FIGS. 23 and 24.

It is noted that in FIGS. 25 and 26, the second and third conductors 92 and 93 are preferably formed in a stepwise or continuously narrowing manner toward the portions connected to the via conductor 51 when viewed in the laminating direction, in terms of providing inductance to shift the attenuation pole toward the lower-frequency side.

Although FIGS. 20 to 26 illustrate examples where electromagnetic coupling means is provided between the input and output lines 3 and 4, there may be employed an arrangement that capacitance or inductance is added as electromagnetic coupling means between any two resonators 1.

Figure 27:
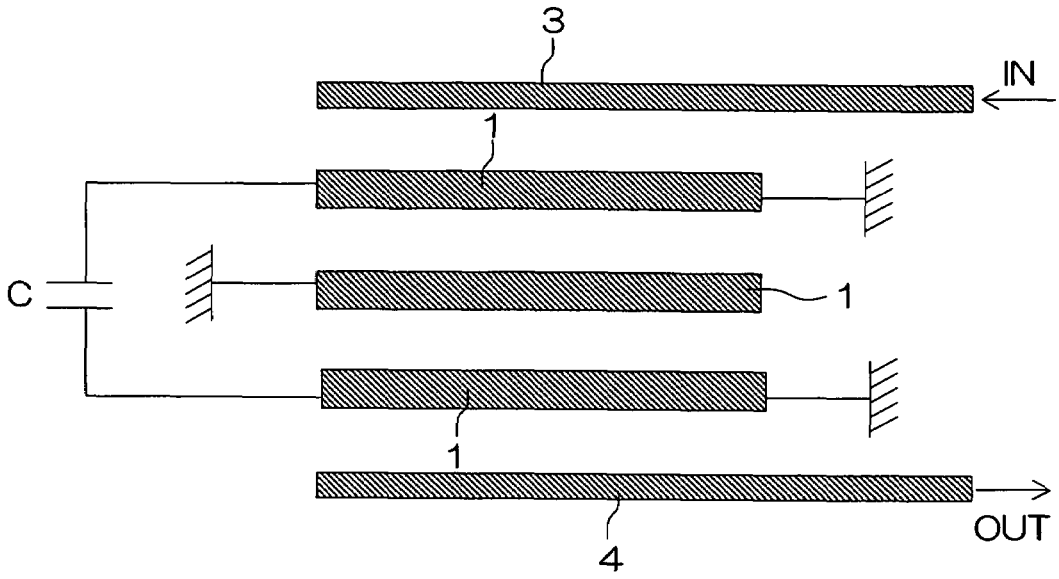
FIG. 27 is an illustrative view showing still another circuit configuration example for forming an attenuation pole in a bandpass filter according to the present invention.
Figure 28:
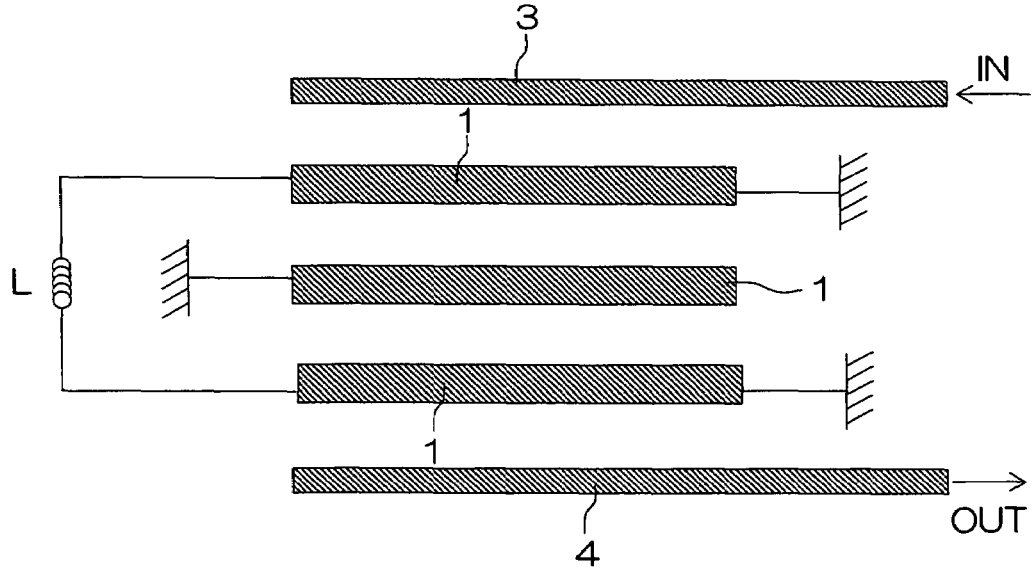
FIG. 28 is an illustrative view showing a further circuit configuration example for forming an attenuation pole in a bandpass filter according to the present invention.

For example, FIG. 27 shows the structure of a bandpass filter including an input line, three resonators, and an output line, in which a capacitive coupling jumper is provided between any two resonators. FIG. 28 shows a structure where an inductive coupling jumper is provided between any two resonators. Thus adding capacitance or inductance between any two resonators for electromagnetic coupling allows a new attenuation pole to be formed outside the pass band and near the boundary between the pass band and the out-of-band region, resulting in further steep skirt characteristics, as is the case of adding capacitance or inductance between input and output parts.

It is noted that the capacitive coupling and the inductive coupling shown in FIGS. 27 and 28 as electromagnetic coupling means may exist at the same time.

In addition, if the number of stages of the bandpass filter is increased, the number of combinations of the positions to provide a coupling jumper is also to be increased. For example, in the case of a five-stage filter, the first and fifth resonators may be coupled, or the second and fourth resonators may be coupled.

Also, in some cases, capacitance or inductance may be added between the input line and a resonator and/or between the output line and a resonator. For example, a coupling jumper may be provided between the input line and the second resonator, and another coupling jumper may be provided between the output line and the fourth resonator.

Figure 29:
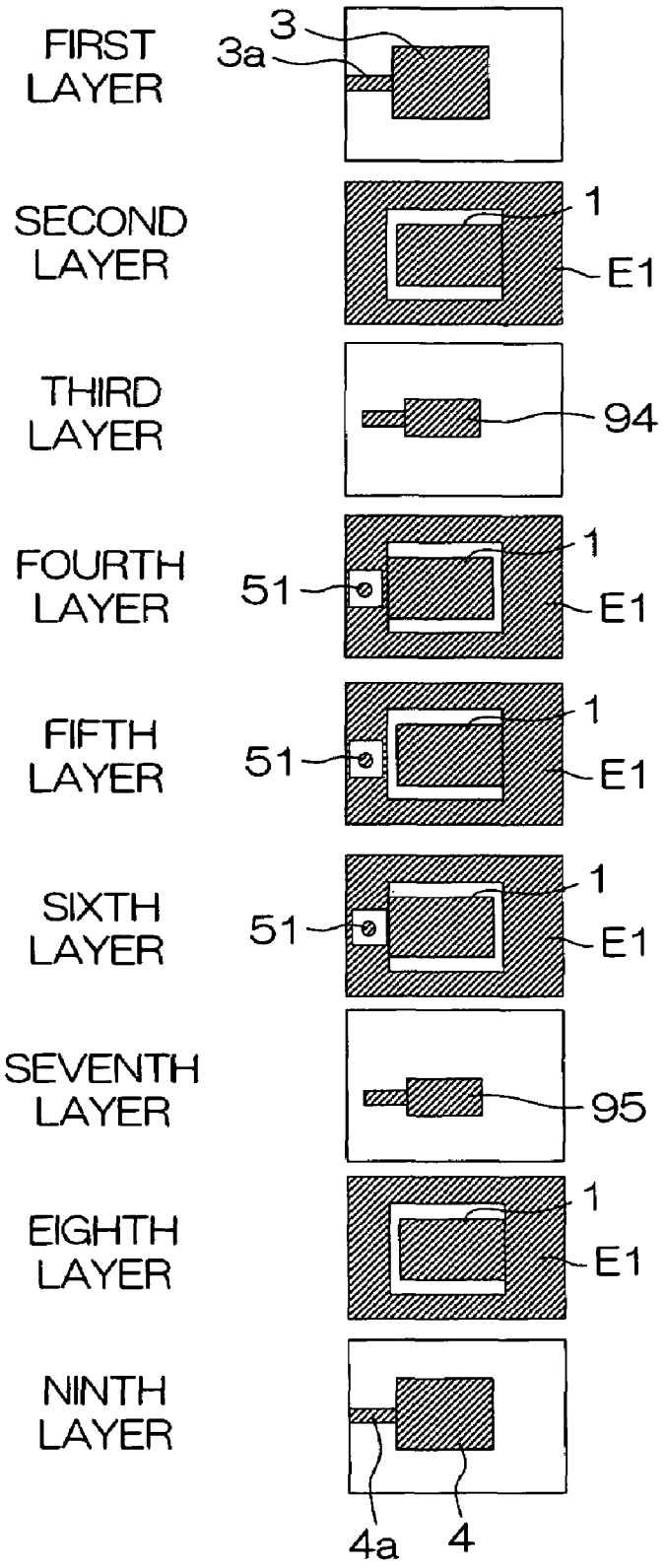
FIG. 29 is an illustrative view showing a conductor pattern example of each layer for forming an attenuation pole in the bandpass filters shown in FIGS. 27 and 28.

As shown in FIG. 29, there can be cited, for example, a structure where a fourth conductor 94 is provided near the upper or lower side of any one resonator among resonators and a fifth conductor 95 is provided near the upper or lower side of a resonator other than the one resonator, and a via conductor 51 for connecting the fourth and fifth conductors 94 and 95 is provided, so that capacitance or inductance is added between the two resonators. This structure allows any resonators to be coupled electromagnetically to have capacitance as shown in FIG. 27 as well as inductance as shown in FIG. 28. In this case, the fourth conductor 94 is to be coupled to a wide portion of the resonator, and the fifth conductor 95 is to be coupled to a wide portion of the resonator, as is the case with the structures shown in FIGS. 25 and 26, offering the advantage that it is easy to form an attenuation pole on the lower-frequency side.

It is noted that the fourth and fifth conductors 94 and 95 are preferably formed in a stepwise or continuously narrowing manner toward the portions connected to the via conductor 51 when viewed in the laminating direction, in terms of providing inductance to shift the attenuation pole toward the lower-frequency side.

Figure 30:
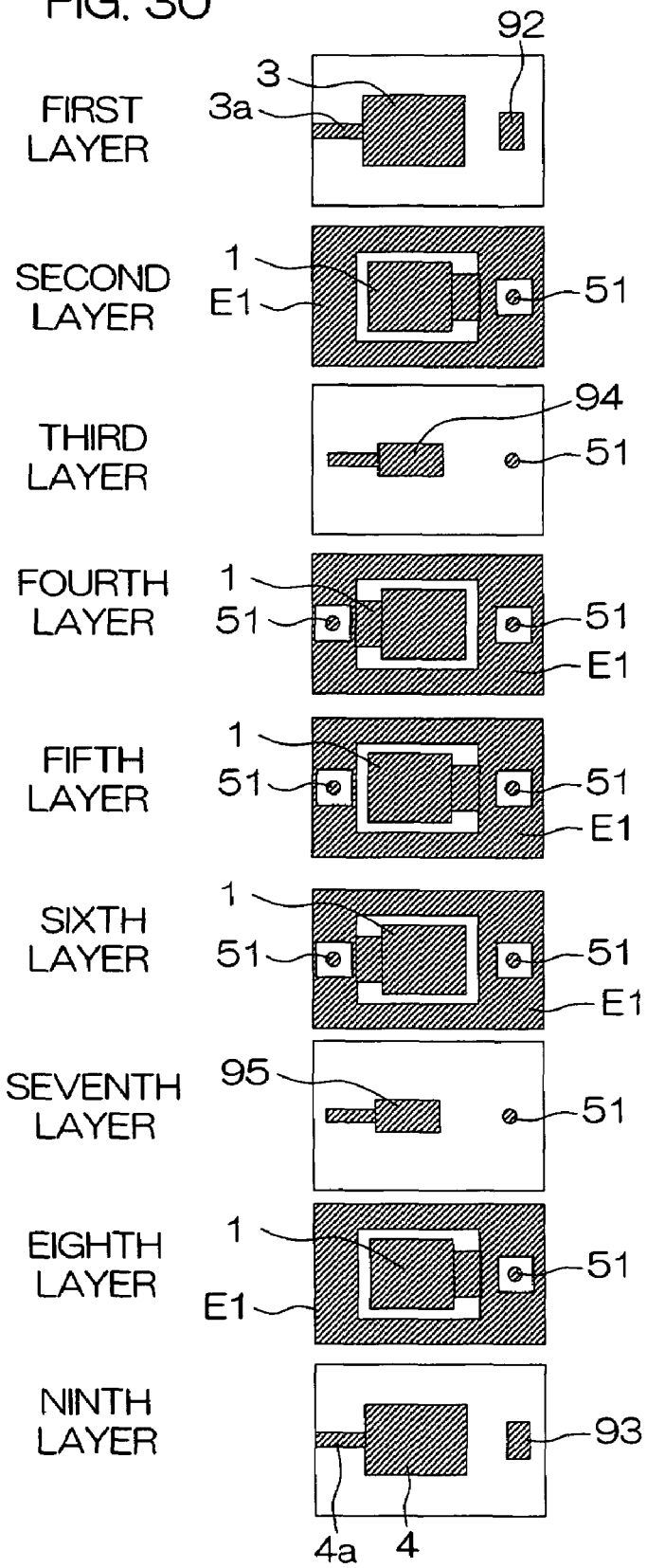
FIG. 30 is an illustrative view showing a conductor pattern example of each layer in a structure obtained by combining the bandpass filters shown in FIGS. 19, 22, and 29.

As an example of combining the above-described arrangements, FIG. 30 shows an example of combining the arrangements shown in FIGS. 19, 22, and 29.

In the above structure, each resonator 1 is formed stepwise toward the grounded end when viewed in the laminating direction. Also, a second conductor 92 is provided in the same plane as an input line 3 and a third conductor 93 is provided in the same plane as an output line 4, and a via conductor 51 for connecting the second and third conductors 92 and 93 is further provided, so that capacitance or inductance is added between the input and output lines 3 and 4. Further, a fourth conductor 94 is provided near the upper or lower side of any one resonator among resonators and a fifth conductor 95 is provided near the upper or lower side of a resonator other than the one resonator, and a via conductor 51 for connecting the fourth and fifth conductors 94 and 95 is provided, so that capacitance or inductance is added between the two resonators.

Here, in the structure shown in FIG. 30, between the input line 3 in the first layer and the fourth conductor 94 in the third layer, there is provided one resonator 1 as the second layer, where the input line 3 may be coupled unnecessarily to the fourth conductor 94 via the clearance between the resonator 1 and the grounding pattern E1 as a grounding conductor to result in a resonance, which may cause an unnecessary out-of-band resonance peak. This can occur similarly between the output line 4 in the ninth layer and the fifth conductor 95 in the fifth layer.

Figure 31:
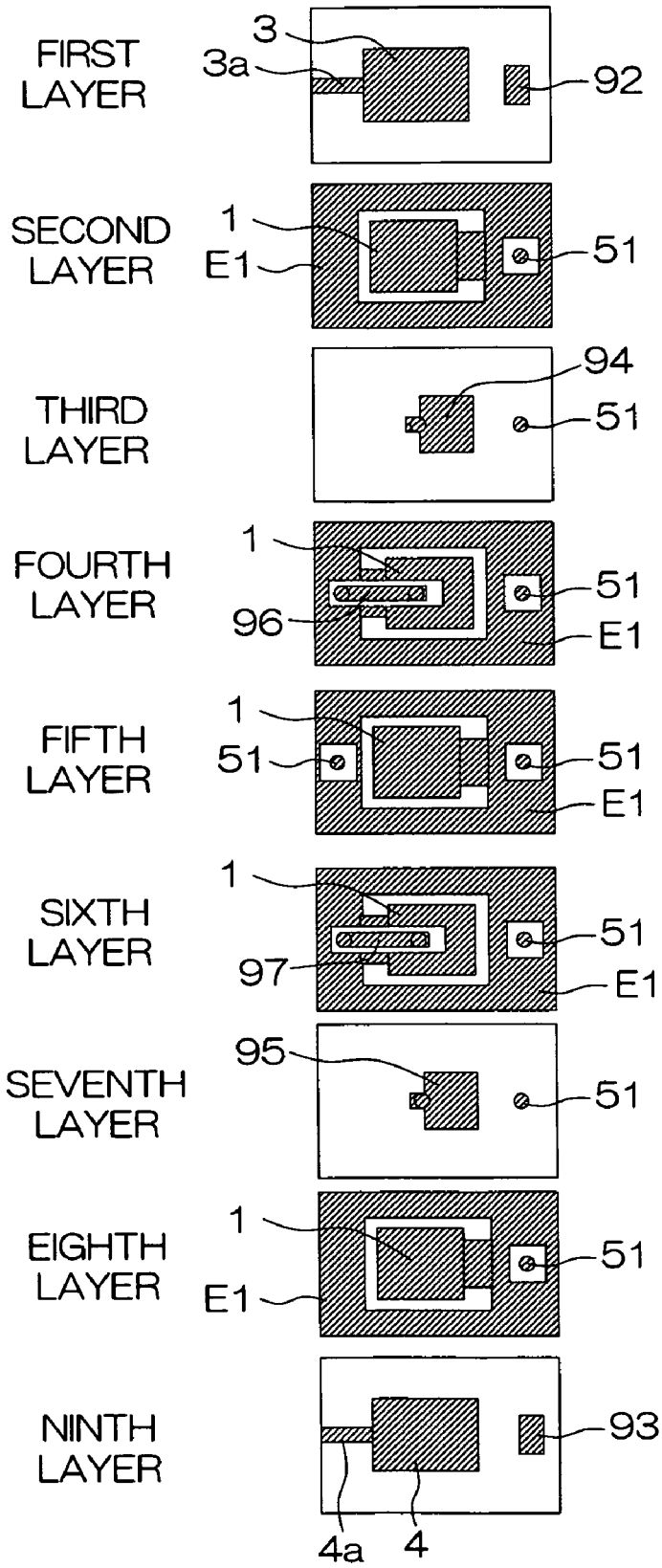
FIG. 31 is an illustrative view showing an improved structural example of the bandpass filter shown in FIG. 30.

Hence, as shown in FIG. 31, it is preferable that the fourth conductor 94 be covered with the resonator 1 in the second layer and the fifth conductor 95 be covered with the resonator 1 in the eighth layer. It is noted here that the term "covered" means that the fourth conductor 94 in the third layer is not formed in a position where to be exposed to the input line 3 via the clearance between the resonator 1 and the grounding pattern E1 in the second layer, and that the fifth conductor 95 in the seventh layer is not formed in a position where to be exposed to the output line 4 via the clearance between the resonator 1 and the grounding pattern E1 in the eighth layer.

In the case above, the fourth conductor 94 is connected to one end of a line-shaped sixth conductor 96 that is formed separately inside the resonator 1 in the fourth layer via a via conductor, and the fifth conductor 95 is connected to one end of a line-shaped seventh conductor 97 that is formed separately inside the resonator 1 in the sixth layer via a via conductor, the other ends of the sixth and seventh conductors 96 and 97 being connected to each other via a via conductor.

This can suppress unnecessary coupling between the input line 3 and the fourth conductor 94 as well as between the output line 4 and the fifth conductor 95. It is noted that the term "separately" means that the sixth and seventh conductors 96 and97 are separated from the resonators 1 through slits formed around the respective conductors.

Figure 32:
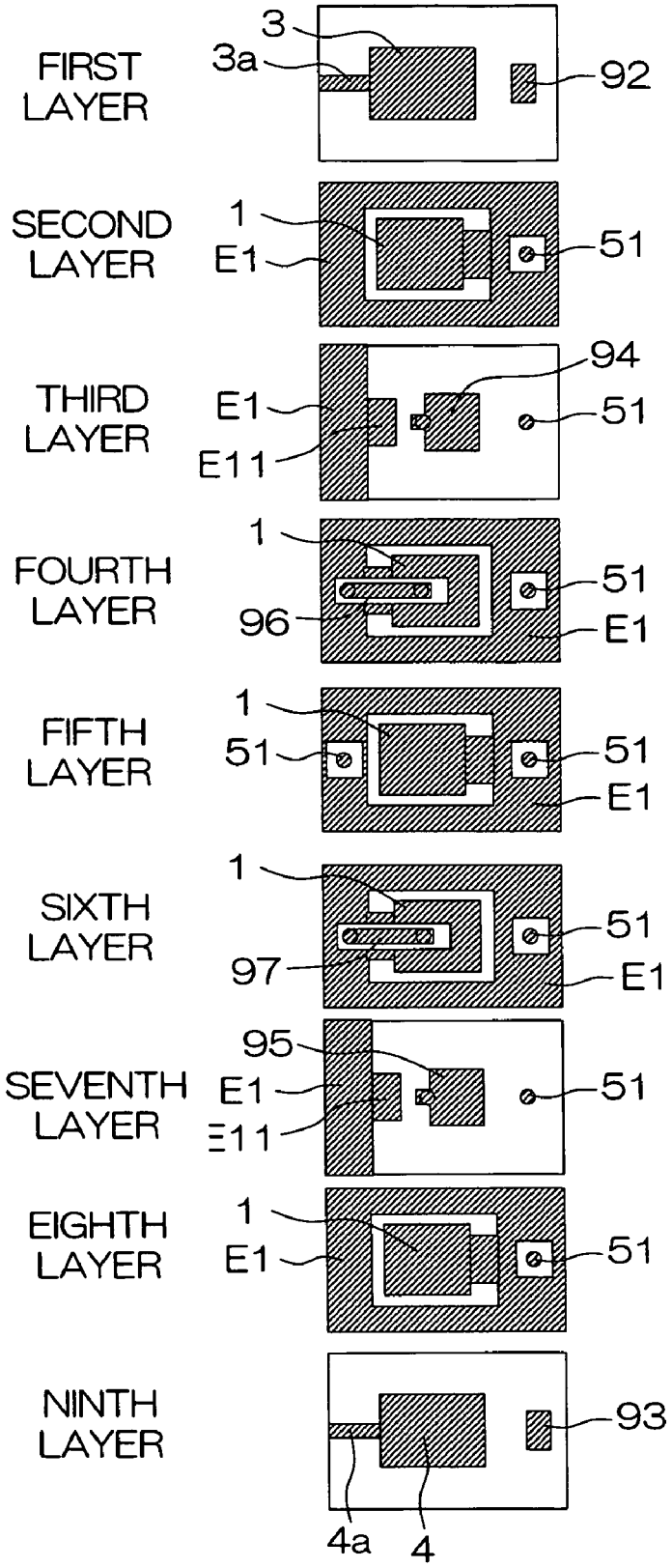
FIG. 32 is an illustrative view showing another improved structural example of the bandpass filter shown in FIG. 30.

As shown in FIG. 32, it is further preferable that the shape of the grounding pattern E1 in the third layer be changed to have a projection E11 and the projection E11 cover the sixth conductor 96 so that the sixth conductor 96 in the fourth layer is not exposed to the input line 3 via the clearance between the resonator 1 and the grounding pattern E1 as a grounding conductor in the second layer. It is also preferable that the shape of the grounding pattern E1 in the seventh layer be changed to have a projection E11 and the projection E11 covers the seventh conductor 97 so that the seventh conductor 97 in the sixth layer is not exposed to the output line 4 via the clearance between the resonator 1 and the grounding pattern E1 in the eighth layer.

The above structure can achieve better out-of-band characteristics than that shown in FIG. 30 and allows attenuation poles to be formed on the lower- and higher-frequency sides.

Next will be described other embodiments in which two structures of laminated resonators 1 and 2 are arranged side by side.

Figure 33:
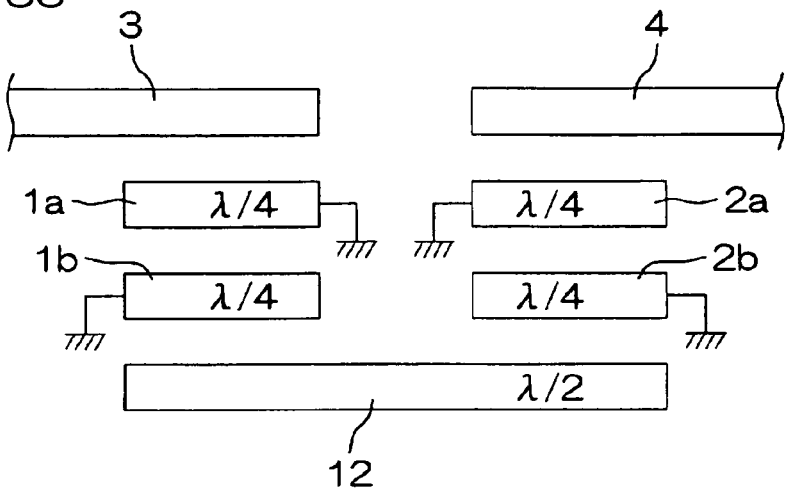
FIG. 33 is an illustrative view showing a bandpass filter in which two structures of resonators are arranged side by side.
Figure 34:
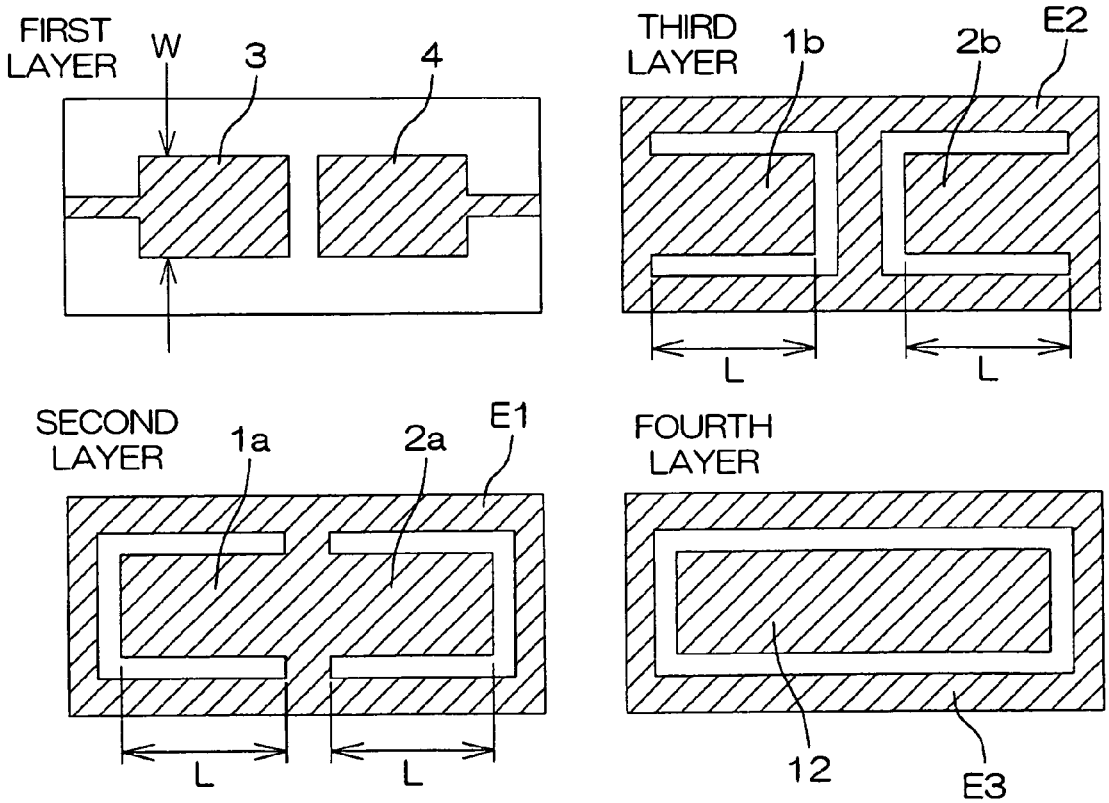
FIG. 34 is an illustrative view showing a conductor pattern example of each layer of the bandpass filter shown in FIG. 33.

FIG. 33 is an illustrative view showing a bandpass filter of the above structure, and FIG. 34 is a plan view showing, in a disassembled manner, a dielectric layer (first layer) provided with the input and output lines 3 and 4, a dielectric layer (second layer) provided with resonators 1*a* and 2*a*, a dielectric layer (third layer) provided with the resonators 1*b* and 2*b*, and a dielectric layer (fourth layer) provided with a coupling conductor, as a specific example of FIG. 33.

In accordance with the above structure, the input and output lines 3 and 4 are formed in the first layer, and the width W of the input and output lines 3 and 4 is narrowed stepwise at the signal input and output ends thereof.

Also, in the second layer, a grounding pattern E1 is formed entirely and "U"-shaped clearances are provided in portions of the grounding pattern E1 corresponding to the laminated structures to form the resonators 1*a* and 2*a*. Also, in the third layer, a grounding pattern E2 is formed entirely and "U"-shaped clearances are provided in portions of the grounding pattern E2 corresponding to the laminated structures to form the resonators 1*b* and 2*b*.

In the fourth layer, there is formed a quadrilateral frame-shaped clearance in a grounding pattern E3 provided entirely in the dielectric layer. The inside of the clearance forms a coupling conductor 12. The coupling conductor 12 is not connected to any conductor. The length of the coupling conductor 12 in the signal propagation direction is basically $\lambda/2$, where $\lambda$ represents a propagation wavelength inside the dielectric layer at approximately the center frequency of the pass band. The coupling conductor 12 has a function of coupling the bottom resonators 1*b* and 2*b* to each other.

As described heretofore, two structures of bandpass filters similar to that shown in FIG. 5 are arranged side by side to turn signals by the coupling conductor 12.

Accordingly, since it is possible to halve the height of the bandpass filters, it is possible to achieve a reduction in the height of wireless communications equipment mounting the same. In addition, since the input and output lines 3 and 4 can be formed on the same dielectric body, input and output signals can be taken in and out easily.

Figure 35:
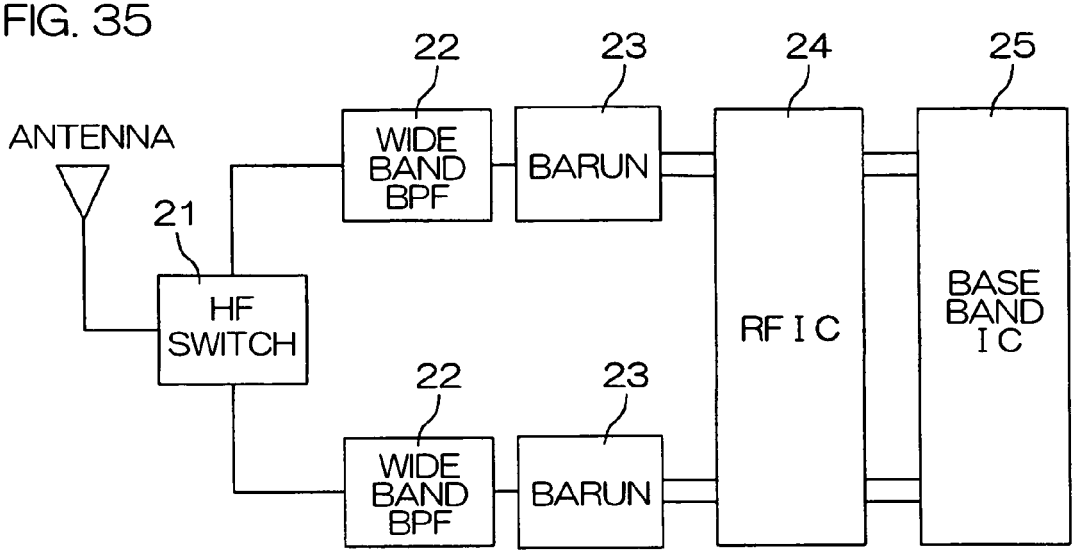
FIG. 35 is a block diagram showing an arrangement example of wireless communications equipment mounting a bandpass filter according to the present invention.

Finally, an arrangement example of wireless communications equipment mounting the above-described bandpass filter is shown in FIG. 35.

In accordance with FIG. 35, the wireless communications equipment includes: a baseband IC 25 for processing baseband signals; an RFIC 24 for processing high-frequency signals; baluns 23 for conversion between balanced signals and unbalanced signals; bandpass filters 22 according to the present invention; a high-frequency switch 21 for switching between transmission and reception; and an antenna. The RFIC 24, baluns 23, bandpass filters 22, and high-frequency switch 21 are incorporated in the same substrate to form a high-frequency module.

The RFIC 24 is adapted to perform frequency conversion and high-frequency amplification for transmitting signals acquired from the baseband IC 25 and to perform low-noise amplification for received signals. The high-frequency switch 21 is adapted to temporally switch the path between transmission and reception.

The bandpass filters 22 have a function of getting the band of UWB transmitting and received signals therethrough and of attenuating out-of-band signals steeply. This function can prevent mutual interference with other systems without attenuating transmitting and received signals.

FIRST EXAMPLE

The transmission characteristics S21 and the reflection characteristics S11 of a bandpass filter having a structure as shown in FIG. 10 where grounding conductors are provided above and below the filter shown in FIG. 1 were calculated using simulation software under the conditions: the relative dielectric constant of the dielectric body is 9.4; capacitors C1=C2=0.6 pF; the length of the resonators 1 and 2 is L=4 mm; the distance between the resonators 1 and 2 is S=0.06 mm; the distance between the upper and lower grounding conductors is D=0.9 mm; and the width of the resonators 1 and 2 is W=0.1 mm.

Figure 36:
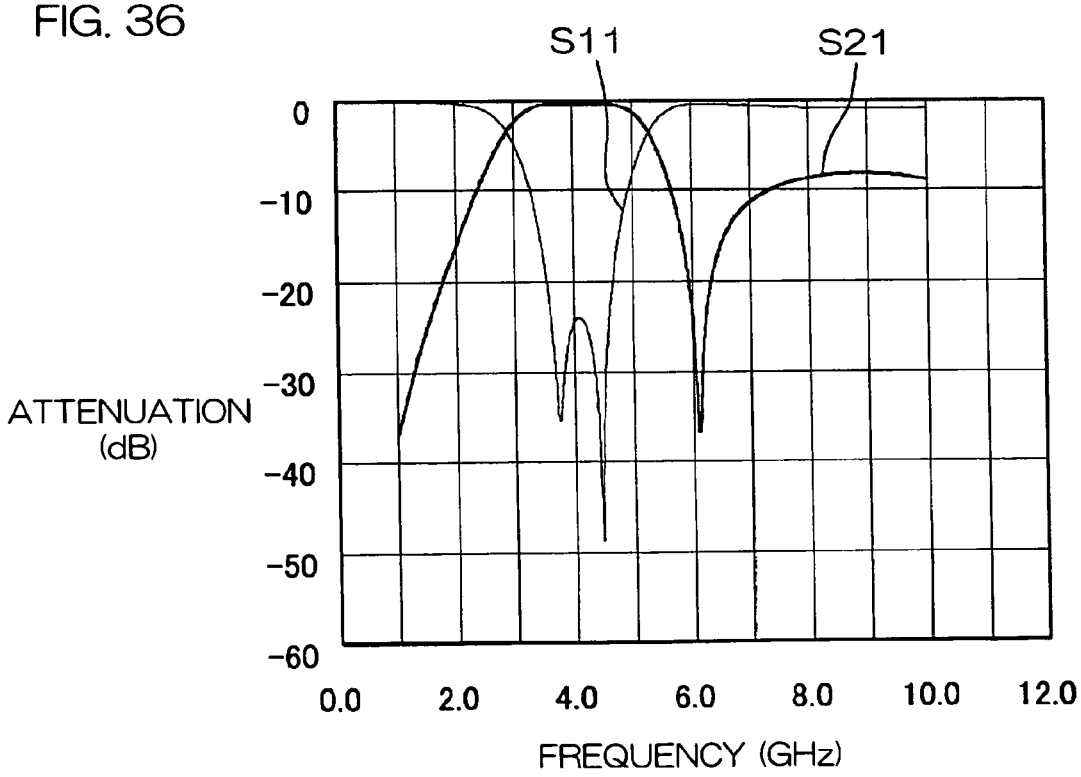
FIG. 36 is a graph showing the transmission characteristics S21 and the reflection characteristics S11 of the bandpass filter shown in FIG. 1 calculated using simulation software.

The results are shown in the graph in FIG. 36. The horizontal axis of the graph represents frequency, while the vertical axis is the amount of attenuation (insertion loss; S12).

FIG. 36 shows that the passing loss within the pass band of about 1.5 GHz from 3.16 to 4.75 GHz is less than 1.5 dB. Also, an attenuation pole appears near 6 GHz. It is further shown that 8 dB of attenuation is performed even at 5.75 GHz or more through 10 GHz.

Accordingly, it can be found that the present invention can achieve a filter having low-loss characteristics within a wide band of 1.5 GHz and steep attenuation characteristics. Also, the filter, which has a sufficiently small thickness D of 0.9 mm, can be mounted on wireless communications equipment having a small height.

SECOND EXAMPLE

Figure 37:
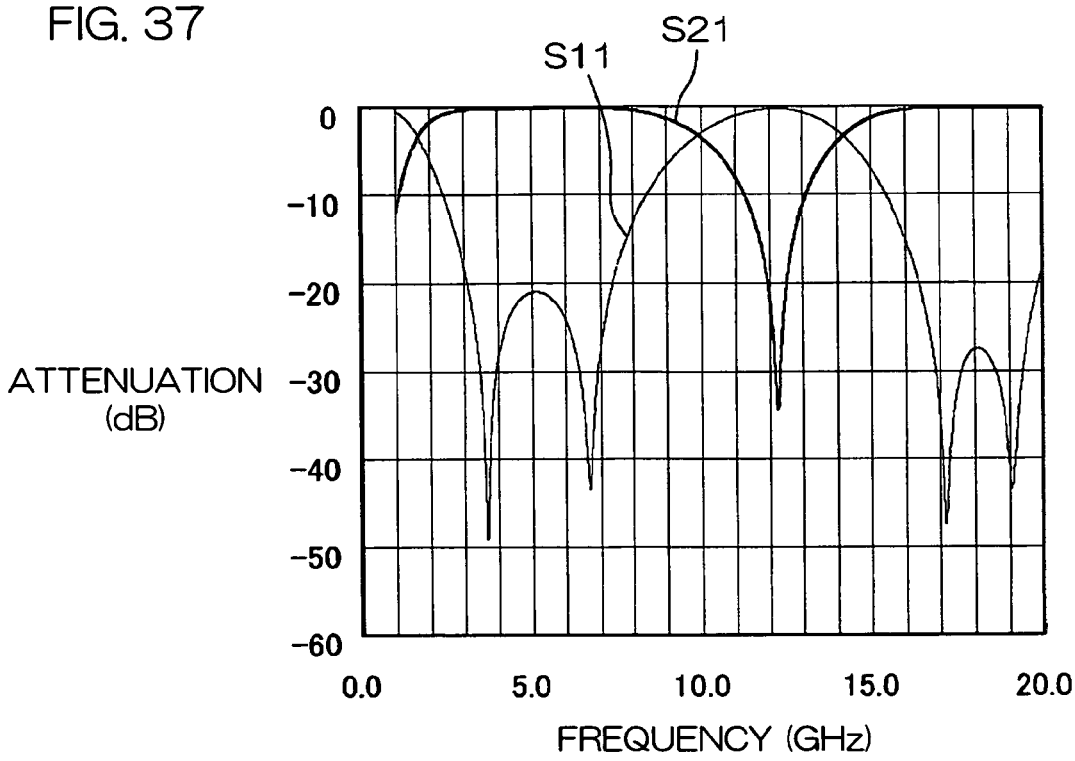
FIG. 37 is a graph showing the transmission characteristics S21 and the reflection characteristics S11 of the bandpass filter shown in FIG. 2 calculated using the simulation software.

FIG. 37 is a graph showing the transmission characteristics S21 and the reflection characteristics S11 when a bandpass filter as shown in FIG. 2, where the input and output ends exist on opposite sides, is sandwiched between upper and lower grounding conductors. The calculation was performed under the conditions: the relative dielectric constant of the dielectric body is 9.4; capacitors C1=C2=3 pF; the length of the resonators 1 and 2 is L=4 mm; the distance between the resonators 1 and 2 is S=0.06 mm; the distance between the upper and lower grounding conductors is D=0.9 mm; and the width of the resonators 1 and 2 is W=0.1 mm.

In accordance with the graph shown in FIG. 37, the pass band is further widened relative to FIG. 36. It is shown that the passing loss is less than 1.5 dB within the pass band. Also, a sufficient amount of attenuation is obtained outside the pass band. The reason for such a wider band being achieved can be considered that since the grounded ends of the resonators 1 and 2 are arranged alternately, the amount of coupling between the resonators is increased.

THIRD EXAMPLE

FIG. 38 is a graph showing the transmission characteristics S21 and the reflection characteristics S11 when a bandpass filter as shown in FIG. 3, where the input and output ends exist on the same side and the open ends of the resonators 1 and 2 are grounded via the lumped constant capacitor elements C1 and C2, is sandwiched between upper and lower grounding conductors. The calculation was performed under the conditions: the relative dielectric constant of the dielectric body is 9.4; capacitors C1=C2=0.8 pF; capacitors C3=C4=0.2 pF; the distance between the resonators 1 and 2 is S=0.06 mm; the distance between the upper and lower grounding conductors is D=0.9 mm; and the width of the resonators 1 and 2 is W=0.1 mm, where the length L of the resonators 1 and 2 was set to 3.5 mm, which is smaller than 4 mm.

In accordance with the graph shown in FIG. 38, the pass band is further widened relative to FIG. 36. It can also be considered that since the length L of the resonators 1 and 2 can be reduced, the size of wireless communications equipment on which the bandpass filter is mounted can be reduced more advantageously.

FOURTH EXAMPLE

Figure 39:
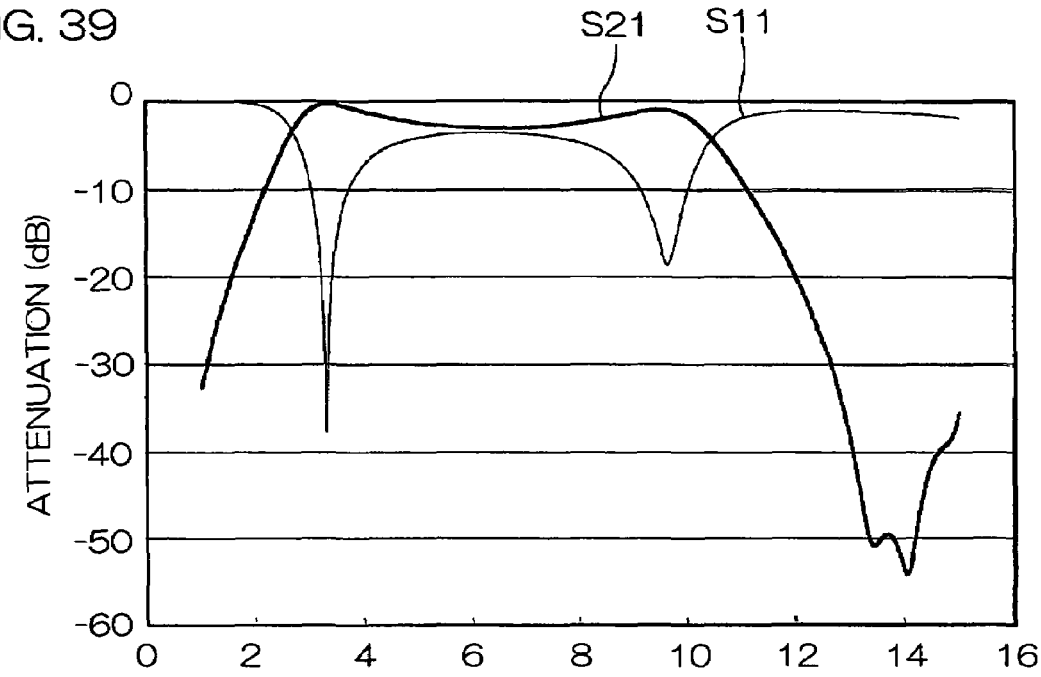
FIG. 39 is a graph showing the transmission characteristics S21 and the reflection characteristics S11 of the bandpass filter shown in FIG. 5 calculated using the simulation software.

FIG. 39 is a graph showing the transmission characteristics S21 and the reflection characteristics S11 of a bandpass filter in which input and output lines 3 and 4 coupled to resonators 1 and 2 are used as signal input and output parts, and grounding patterns E1 and E2 are formed on the dielectric layers in which the respective resonators 1 and 2 are formed, that is, a bandpass filter as shown in FIGS. 5 and 11. The calculation was performed under the conditions: the relative dielectric constant of the dielectric body is 2.2; the length of the resonators 1 and 2 is L=7 mm; the distance between the input line 3 and the resonator 1 is 0.51 mm; the distance between the resonators 1 and 2 is S=0.51 mm; the distance between the resonator 2 and the output line 4 is 0.51 mm; the distance between the input and output lines 3 and 4 is D=1.55 mm; and the widths of the input and output lines 3 and 4 and the resonators 1 and 2 are, respectively, W=3.8 mm and Wa=1.6 mm.

In accordance with the graph shown in FIG. 39, it can be found that although about 3 dB of passing attenuation occurs within the pass band, wideband transmission characteristics are obtained.

FIFTH EXAMPLE

Figure 40:
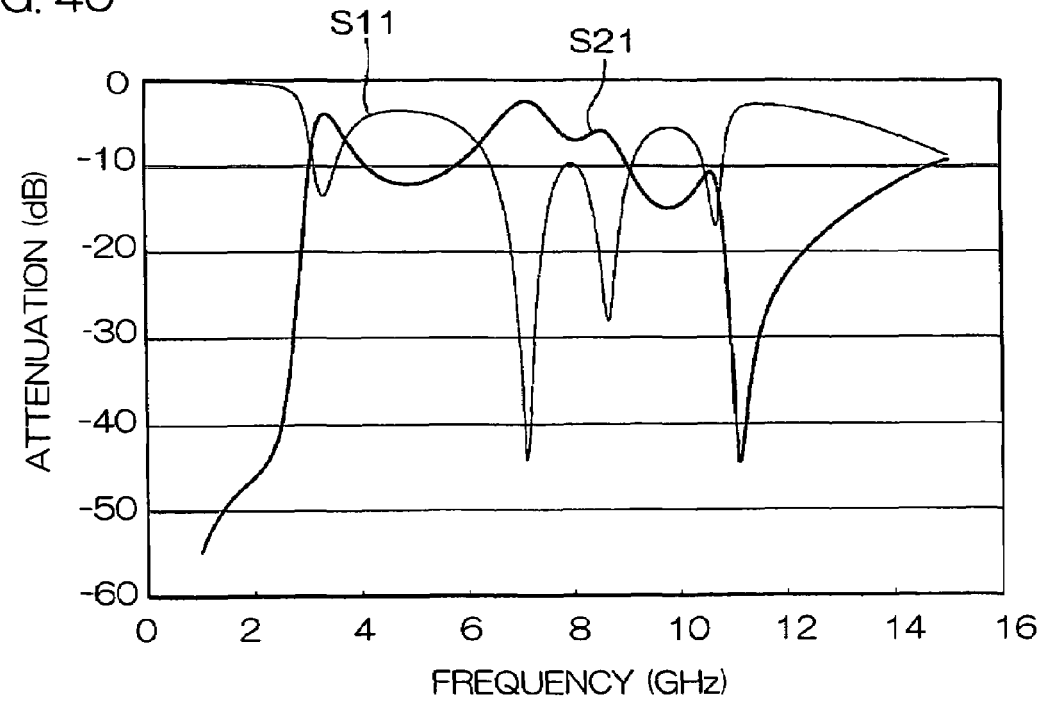
FIG. 40 is a graph showing the transmission characteristics S21 and the reflection characteristics S11 of the bandpass filter shown in FIG. 33 in which two structures of two resonators that are laminated vertically are arranged side by side.

FIG. 40 is a graph showing the transmission characteristics S21 and the reflection characteristics S11 of a bandpass filter as shown in FIGS. 33 and 34, where the two structures of the two vertically laminated resonators are arranged side by side. The calculation was performed under the conditions: the relative dielectric constant of the dielectric body is 2.2; the length of the resonators 1 and 2 is L=7 mm; the distance between the input line 3 and the resonator 1 is 0.51 mm; the distance between the resonators 1 and 2 is S=0.51 mm; the distance between the resonator 2 and the output line 4 is 0.51 mm; the distance between the input and output lines 3 and 4 is D=1.55 mm; and the widths of the input and output lines 3 and 4 and the resonators 1 and 2 are, respectively, W=3.8 mm and Wa=1.6 mm.

In accordance with the graph shown in FIG. 40, it can be found that although the loss within the pass band increases relative to the foregoing graphs, wideband transmission characteristics are obtained and the out-of-band attenuation characteristics become steeper.

SIXTH EXAMPLE

Figure 41:
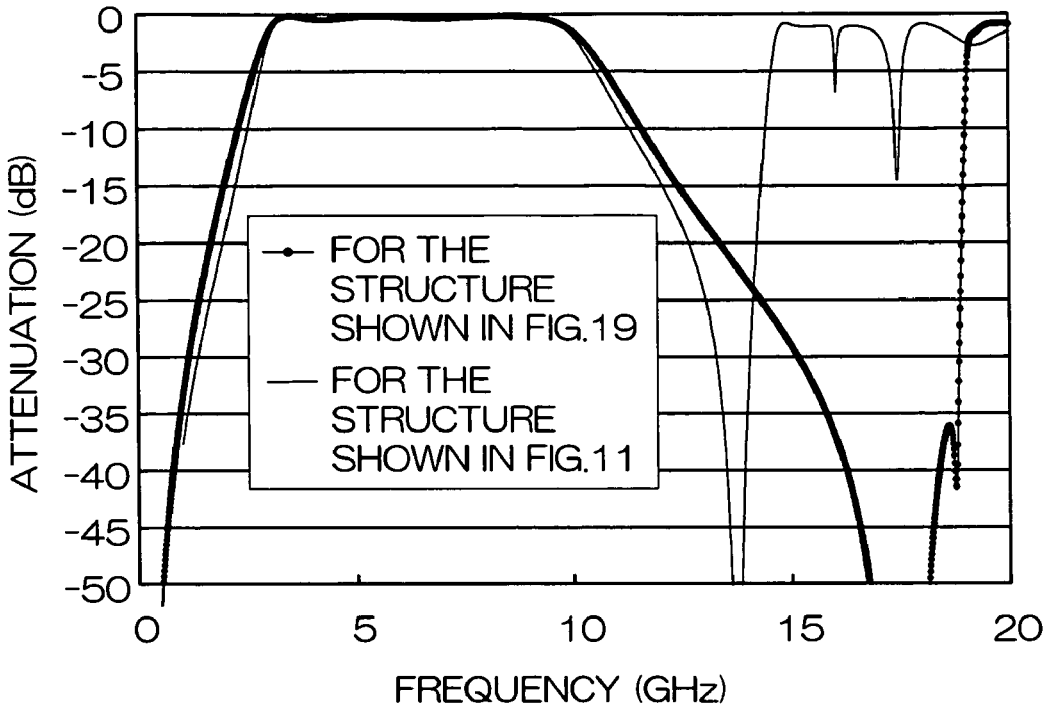
FIG. 41 is a graph showing the transmission characteristics S21 of the bandpass filter shown in FIG. 19 calculated using the simulation software.

FIG. 41 is a graph showing the transmission characteristics S21 of a bandpass filter in which input and output lines 3 and 4 coupled to a resonator 1 are used as signal input and output parts, and a grounding pattern E1 is formed on the dielectric layer in which the resonator 1 is formed to add inductance to each resonator, that is, a five-stage filter as shown in FIGS. 18 and 19. Here, as shown in FIGS. 18 and 19, the resonators 1 and 2 are formed stepwise toward the grounded ends when viewed in the laminating direction. It is noted that the calculation result for a five-stage filter having a structure as shown in FIG. 11 (the structure in FIG. 19 with no step in the electrodes), where no new attenuation pole is formed, will be shown together for comparison.

The calculation was performed under the conditions: the relative dielectric constant of the dielectric body is 2.2; the length of the conventional resonator 1 is L=7 mm; the length of the resonator with steps is L=5.5 mm (including the width and length of the step portions $W_0$=0.6 mm and $L_0$=0.4 mm); the distance between the input line 3 and the resonator 1 is 0.2 mm; the distance between the resonators is S=0.65 mm; the distance between the resonator 2 and the output line 4 is 0.2 mm; and the widths and length of the input and output lines 3 and 4 and the resonator 1 are, respectively, W=3.2 mm, Wa=0.6 mm, and L=5.5 mm.

The length of the resonators is reduced by 1.5 mm relative to the structure shown in FIG. 11 by forming the resonators 1 and 2 stepwise as shown in FIG. 19, which can achieve size reduction.

Also, in accordance with the graph shown in FIG. 41, the out-of-band characteristics on the higher-frequency side are improved significantly. In this case, the attenuation range of, for example, −20 dB or less is up to 15 GHz for the structure shown in FIG. 11, while it is improved up to 19 GHz for the structure shown in FIG. 19.

SEVENTH EXAMPLE

Figure 42:
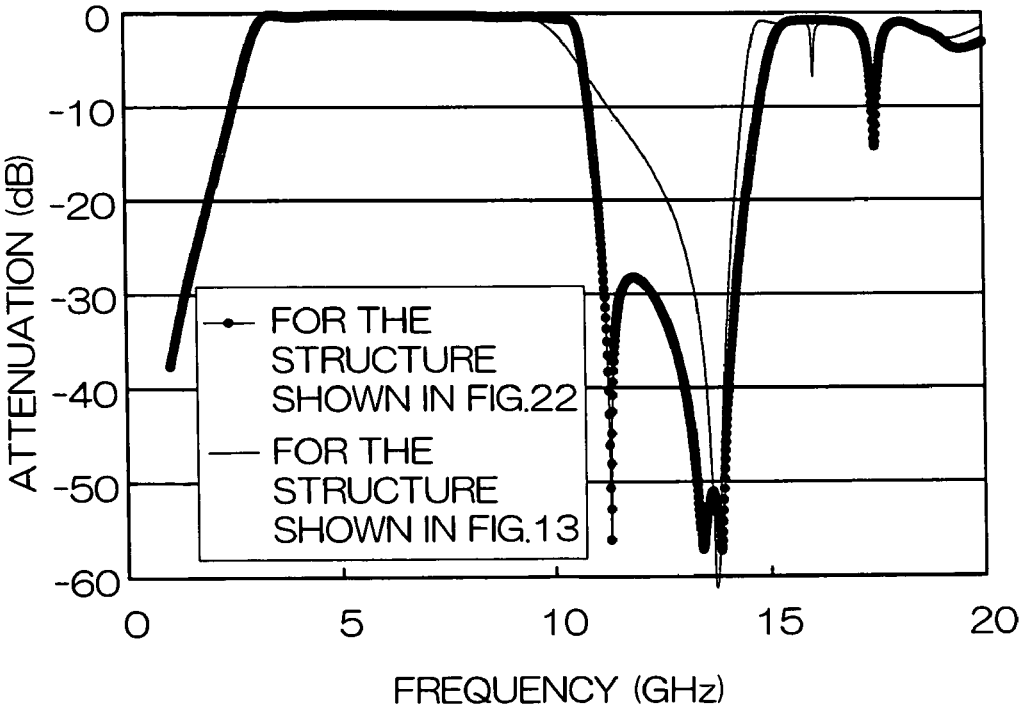
FIG. 42 is a graph showing the transmission characteristics S21 of the bandpass filter shown in FIG. 22 calculated using the simulation software.

FIG. 42 is a graph showing the transmission characteristics S21 of a bandpass filter in which input and output lines 3 and 4 coupled to resonators 1 are used as signal input and output parts, and grounding patterns E1 are formed in such a manner as to surround the resonators 1 to form conductors on the same plane as the respective input and output lines 3 and 4 and to connect the conductors via a via conductor 51 for coupling between input and output, that is, a five-stage bandpass filter as shown in FIG. 22.

Here, the calculation result for a five-stage filter having a structure as shown in FIG. 13 (the structure in FIG. 22 with neither second conductor 92, third conductor 93, nor via conductor), where no new attenuation pole is formed, will be shown together for comparison. The calculation was performed under the conditions: the relative dielectric constant of the dielectric body is 2.2; the length of the resonators 1 is L=7 mm; the distance between the input line 3 and the resonators 1 is 0.2 mm; the distance between the resonators is S=0.75 mm; the widths of the input and output lines 3 and 4 and the resonators 1 are, respectively, W=3.4 mm and Wa=0.6 mm; the width and the length of the electrode 9 are, respectively, W=0.8 mm and L=0.7 mm; and the distance between the electrode 9 and the input and output lines 3 and 4 is g=0.7 mm.

In accordance with the graph shown in FIG. 42, a new attenuation pole is formed on the higher-frequency side for the structure shown in FIG. 22, and steeper skirt characteristics are achieved relative to the structure shown in FIG. 13. Using this technique allows steep skirt characteristics to be achieved with a small number of stages, being effective in size reduction and loss reduction.

EIGHTH EXAMPLE

Figure 43:
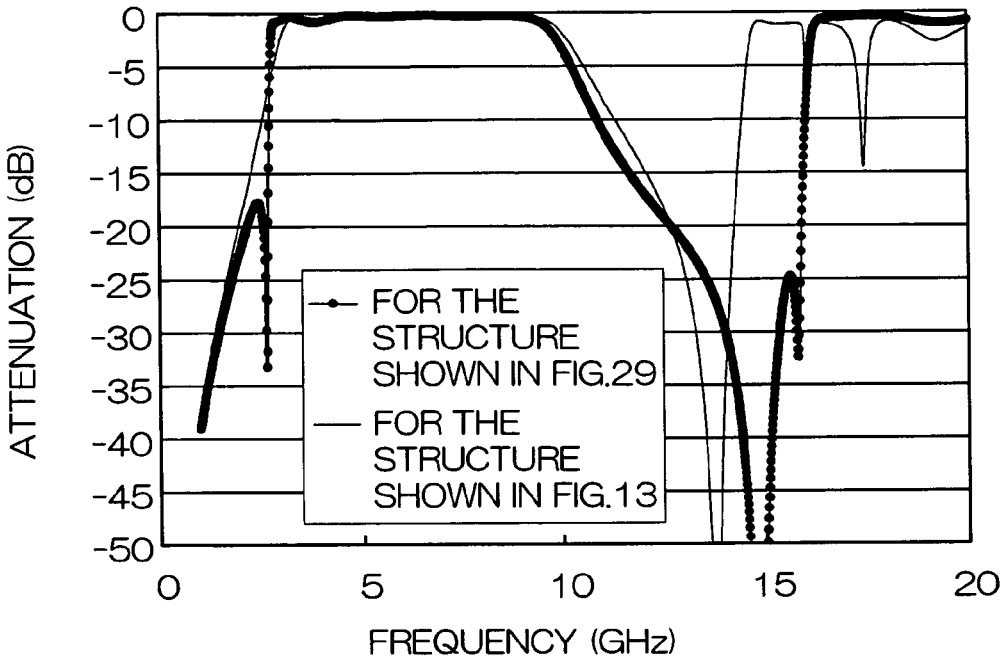
FIG. 43 is a graph showing the transmission characteristics S21 of the bandpass filter shown in FIG. 29 calculated using the simulation software.

FIG. 43 is a graph showing the transmission characteristics S21 of a bandpass filter in which input and output lines 3 and 4 coupled to resonators 1 are used as signal input and output parts, and grounding patterns E1 are formed in such a manner as to surround the resonators 1 to form a conductor near the upper or lower side of any resonator and a conductor near the upper or lower side of a resonator other than the former resonator, the conductors being connected via a via conductor 51, that is, a five-stage bandpass filter as shown in FIG. 29.

Here, the calculation result for a five-stage filter having a structure as shown in FIG. 13 (the structure in FIG. 25 with neither fourth conductor 94, fifth conductor 95, nor via conductor 51), where no new attenuation pole is formed, will be shown together for comparison. The calculation was performed under the conditions: the relative dielectric constant of the dielectric body is 2.2; the length of the resonators 1 is L=7 mm; the distance between the input line 3 and the resonators 1 is 0.2 mm; the distance between the resonators is S=0.75 mm; the widths of the input and output lines 3 and 4 and the resonators 1 are, respectively, W=3.4 mm and Wa=0.6 mm; the width and the length of the electrode 9 are, respectively, W=3.4 mm and L=6.6 mm; and the distance between the electrode 9 and the resonators 1 in the fourth and seventh layers is d=0.2 mm.

In accordance with the graph shown in FIG. 43, a new attenuation pole is formed on the lower-frequency side for the structure shown in FIG. 22, and steeper skirt characteristics are achieved relative to the structure shown in FIG. 13. Using this technique allows steep skirt characteristics to be achieved with a small number of stages, being effective in size reduction and loss reduction.

In addition, creating structures as shown in FIGS. 22 and 29 allows attenuation poles to be formed on the lower- and higher-frequency sides, resulting in steep skirt characteristics.

NINTH EXAMPLE

The transmission characteristics S21 of a bandpass filter having a structure as shown in FIG. 30 were calculated using the simulation software.

The calculation was performed under the conditions: the relative dielectric constant of the dielectric body is 2.2; the length and the width of the resonators 1 with steps are, respectively, L=5.2 mm and W=3.2 mm (including the width and length of the step portions $W_0$=1.1 mm and $L_0$=0.4 mm); the distance between the input line 3 and the resonators 1 is 0.2 mm; the distance between the resonators is S=0.65 mm; the distance between the resonators and the output line 4 is 0.2 mm; the width and the length of the input and output lines 3 and 4 are, respectively, W=3.2 mm and L=5.4 mm; the width of the input and output lines 3*a* and 4*a* is Wa=0.6 mm; the length and the width of the electrodes 92 and 93 are, respectively, Lg=0.7 mm and Wg=1.0 mm; the distance from the input and output lines 3 and 4 is g=0.5 mm; the width and the length of the fourth and fifth conductors 94 and 95 are, respectively, W=3.0 mm and L=4.4 mm; the width and the length of the line 2 are, respectively, W=0.1 mm and L=1.2 mm; and the distance between the fourth and fifth conductors 94 and 95 and the resonators 1 in the fourth and sixth layers is d=0.2 mm.

Meanwhile, the transmission characteristics S21 of a bandpass filter having a structure as shown in FIG. 32 were calculated using the simulation software. The calculation was performed under the conditions: the relative dielectric constant of the dielectric body is 2.2; the length and the width of the resonators 1 with steps are, respectively, L=5.2 mm and W=3.2 mm (including the width and length of the step portions $W_0$=1.2 mm and $L_0$=0.4 mm); the distance between the input line 3 and the resonators 1 is 0.2 mm; the distance between the resonators is S=0.65 mm; the distance between the resonators and the output line 4 is 0.2 mm; the width and the length of the input and output lines 3 and 4 are, respectively, W=3.2 mm and L=5.4 mm; the width of the input and output lines 3*a* and 4*a* is Wa=0.6 mm; the length and the width of the second and third conductors 92 and 93 are, respectively, Lg=0.6 mm and Wg=1.0 mm; the distance from the input and output lines 3 and 4 is g=0.5 mm; the width and the length of the fourth and fifth conductors 94 and 95 are, respectively, W=3.0 mm and L=3.6 mm; the width and the length of the sixth conductor 96 in the fourth layer and the seventh conductor 97 in the sixth layer are, respectively, W=0.2 mm and L=2.0 mm; the distance between the fourth and fifth conductors 94 and 95 and the resonators 1 in the fourth and sixth layers is d=0.2 mm; and the width and the length of the projections E11 in the third and seventh layers are, respectively, W=1.2 mm and L=0.8 mm.

Figure 44:
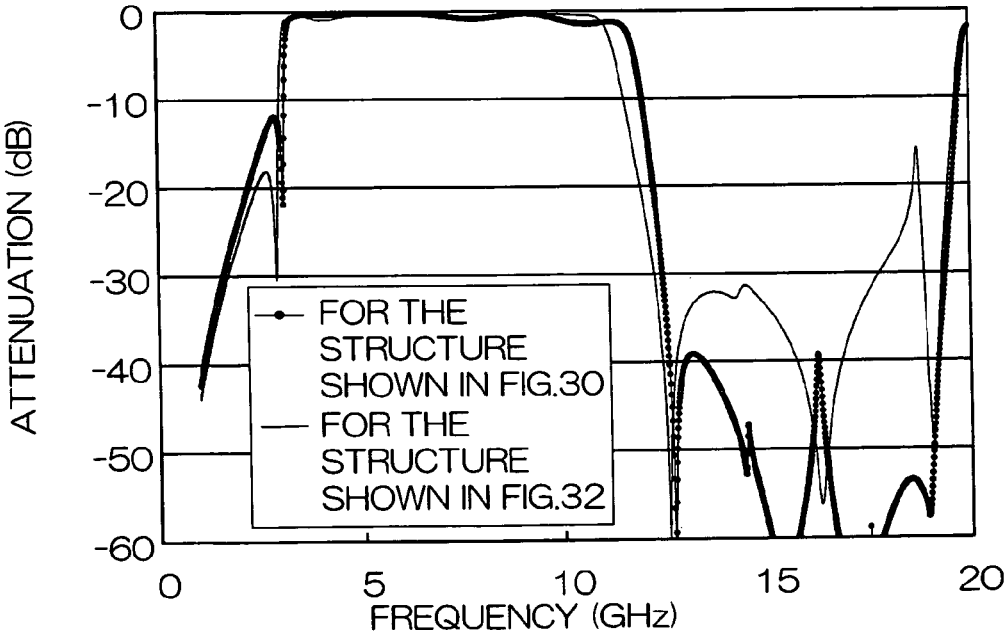
FIG. 44 is a graph showing a comparison of the transmission characteristics S21 between the bandpass filters shown in FIGS. 30 and 32 calculated using the simulation software.
Figure 45:
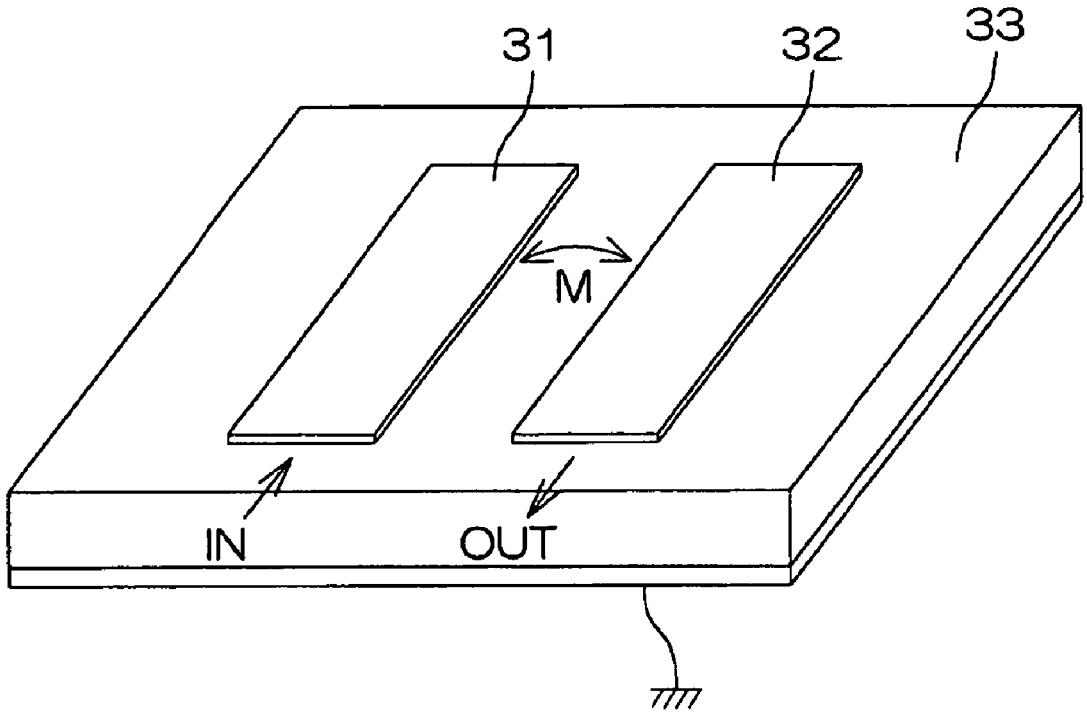
FIG. 45 ( PRIOR ART )
FIG. 45 is a perspective view showing a conventional planar circuit filter in which two microstrip lines are arranged side by side on a dielectric substrate.

The calculation results are shown in FIG. 44.

In accordance with the graph shown in FIG. 44, any of the structures shown in FIGS. 30 and 32 can form attenuation poles on the lower- and higher-frequency sides, resulting in steep skirt characteristics. Using this technique allows steep skirt characteristics to be achieved with a small number of stages, being effective in size reduction and loss reduction. However, the structure shown in FIG. 30 causes out-of-band sharp resonance peaks to deteriorate the out-of-band characteristics somewhat. On the other hand, the structure shown in FIG. 32 suppresses such resonance peaks to achieve good out-of-band characteristics widely.

What is claimed is:

1. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, wherein one end of each of the N resonators is grounded, the grounded one end of each of the resonators exists at the opposite end to that of a former resonator when viewed in the laminating direction, and a length of each of the N resonators in a signal propagation direction is basically λ/4, where λ represents a propagation wavelength at approximately a center frequency of a pass band.

2. The bandpass filter according to claim 1, wherein the resonators each include a strip line, a microstrip line, or a coplanar line.

3. The bandpass filter according to claim 1, wherein the resonators are formed in a rectangular shape when viewed in the laminating direction, and grounding conductors are provided in a same plane as the respective resonators in such a manner as to surround the respective resonators so that the only one ends of the rectangular resonators are grounded.

4. The bandpass filter according to claim 3, wherein capacitance is added between open ends at opposite to the grounded ends and portions of the grounding conductors neat the open ends.

5. The bandpass filter according to claim 3, wherein the N resonators are formed in a stepwise or continuously narrowing manner toward the grounded ends when viewed in the laminating direction.

6. The bandpass filter according to claim 1, wherein capacitance or inductance is added between any two resonators selected among the N resonators.

7. A high-frequency module comprising a bandpass filter according to claim 1.

8. Wireless communications equipment using a high frequency module according to claim 7.

9. Wireless communications equipment using a bandpass filter according to claim 1.

10. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, the input and output parts including a capacitor or inductor element coupled to the resonators, wherein one end of each of the N resonators is grounded, the grounded one end of each of the resonators exists at the opposite end to that of a former resonator when viewed in the laminating direction, and a length of each of the N resonators in a signal propagation direction is basically λ/4, where λ represents a propagation wavelength at approximately a center frequency of a pass band.

11. The bandpass filter according to claim 1, wherein the input and output parts include input and output lines coupled to the resonators.

12. The bandpass filter according to claim 11, wherein a width of the input or output line is formed stepwise at the end of a portion overlapping the resonators when viewed in the laminating direction.

13. The bandpass filter according to claim 11, wherein an input direction to the input line is different from the output direction from the output line.

14. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, the input and output parts including input and output lines coupled to the resonators, wherein an input direction to the input line is the same as an output direction from the output line, wherein one end of each of the N resonators is grounded, and a length of each of the N resonators in a signal propagation direction is basically λ/4, where λ represents a propagation wavelength at approximately a center frequency of a pass band.

15. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, wherein the respective resonators are formed in a rectangular space when viewed in the laminating direction, and grounding conductors are provided in a same plane as the respective resonators in such a manner as to surround the respective resonators so that the only one ends of the rectangular resonators are grounded, wherein first conductors are provided near an upper or lower side in the laminating direction of open ends in the resonators, and via conductors for connecting the first conductors and the respective grounding conductors are provided, and wherein a length of each of the N resonators in a signal propagation direction is basically λ/4, where λ represents a propagation wavelength at approximately a center frequency of a pass band.

16. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, the input and output parts including input and output lines coupled to the resonators, wherein capacitance or inductance is added between the input and output lines bridging resonators that exist between the two resonators that are coupled to the input and output parts respectively, wherein one end of each of the N resonators is grounded, the grounded one end of each of the resonators exists at the opposite end to that of a former resonator when viewed in the laminating direction, and a length of each of the N resonators in a signal propagation direction is basically λ/4, where λ represents a propagation wavelength at approximately a center frequency of a pass band.

17. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, the input and output parts including input and output lines coupled to the resonators, wherein capacitance or inductance is added between the input and output lines, wherein one end of each of the N resonators is grounded, and a length of each of the N resonators in a signal propagation direction is basically λ/4, where λ represents a propagation wavelength at approximately a center frequency of a pass band, wherein a second conductor is provided in a same plane as the input line and a third conductor is provided in the same plane as the output line, and wherein a via conductor for connecting the second and third conductors is provided.

18. The bandpass filter according to claim 17, wherein the second and third conductors are formed in a stepwise or continuously narrowing manner toward portions connected to the via conductor when viewed in the laminating direction.

19. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, the input and output parts including input and output lines coupled to the resonators, wherein capacitance or inductance is added between the input and output lines, wherein one end of each of the N resonators is grounded, and a length of each of the N resonators in a signal propagation direction is basically λ/4, where λ represents a propagation wavelength at approximately a center frequency of a pass band, wherein a second conductor is provided near the upper or lower side in the laminating direction of the input line and a third conductor is provided near an upper or lower side in the laminating direction of the output line, and wherein a via conductor for connecting the second and third conductors is provided.

20. The bandpass filter according to claim 19, wherein the second and third conductors are formed in a stepwise or continuously narrowing manner toward portions connected to the via conductor when viewed in the laminating direction.

21. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, wherein capacitance or inductance is added between any two resonators selected among the N resonators, wherein a fourth conductor is provided near the upper or lower side of any one resonator among the N resonators and a fifth conductor is provided near an upper or lower side of a resonator other than the one resonator, and wherein a via conductor for connecting the fourth and fifth conductors is provided, wherein one end of each of the N resonators is grounded, and a length of each of the N resonators in a signal propagation direction is basically λ/4, where λ represents a propagation wavelength at approximately a center frequency of a pass band.

22. The bandpass filter according to claim 21, wherein at least one resonator of the N resonators is provided between the fourth or fifth conductor and the input or output part, and the resonator covers the fourth and fifth conductors when viewed from the input and output parts.

23. The bandpass filter according to claim 21, wherein the fourth and fifth conductors are formed in a stepwise or continuously narrowing manner toward portions connected to the via conductor when viewed in the laminating direction.

24. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, wherein one end of each of the N resonators is grounded, two laminated structures each composed of the N resonators are arranged side by side, the number of the laminated resonators is the same for each of the laminated structures, the two resonators coupled respectively, to the input and output parts arranged on the top of each of the laminated structures, and a coupling conductor for coupling the bottom resonators to each other is arranged across the two structures, and a length of each of the N resonators in a signal propagation direction is basically λ/4, where λ represents a propagation wavelength at approximately a center frequency of a pass band.

25. A bandpass filter comprising:

N (N≧2) resonators arranged in an at least partially overlapped manner when viewed in a laminating direction to be coupled electromagnetically to each other; and input and output parts coupled, respectively, to two resonators selected among the N resonators, wherein one end of each of the N resonators is grounded, the grounded one end of each of the resonators exists at the same end of the resonators when viewed in the laminating direction, the input and output parts are on the same end of the grounded end of the resonators, and a length of each of the N resonators in a signal propagation direction is basically λ/4, where λ represents a propagation wavelength at approximately a center frequency of a pass band.

* * * * *